US009167906B2

(12) United States Patent
Dehli

(10) Patent No.: US 9,167,906 B2
(45) Date of Patent: Oct. 27, 2015

(54) COMPUTER COMPONENT MOUNTING DEVICE FOR A CHAIR

(71) Applicant: Human Touch, LLC, Long Beach, CA (US)

(72) Inventor: Hans Dehli, San Clemente, CA (US)

(73) Assignee: HUMAN TOUCH, LLC, Long Beach, CA (US)

( * ) Notice: Subject to any disclaimer, the term of this patent is extended or adjusted under 35 U.S.C. 154(b) by 0 days.

(21) Appl. No.: 14/256,326

(22) Filed: Apr. 18, 2014

(65) Prior Publication Data

US 2014/0225402 A1 Aug. 14, 2014

Related U.S. Application Data

(63) Continuation-in-part of application No. 13/306,932, filed on Nov. 29, 2011, now Pat. No. 8,870,280.

(51) Int. Cl.

| | |
|---|---|
| ***A47B 83/02*** | (2006.01) |
| ***A47C 7/72*** | (2006.01) |
| ***A47C 7/70*** | (2006.01) |

(52) U.S. Cl.
CPC . *A47C 7/72* (2013.01); *A47B 83/02* (2013.01); *A47C 7/70* (2013.01)

(58) Field of Classification Search
CPC ..... A47C 7/70; A47C 7/62; A47C 7/68; A47B 83/02; A47B 23/02
USPC ..... 297/173; 108/50.11
See application file for complete search history.

(56) References Cited

U.S. PATENT DOCUMENTS

| | | | | | |
|---|---|---|---|---|---|
| 137,069 | A | | 3/1873 | Goss | |
| 175,176 | A | * | 3/1876 | Sheldon | 297/170 |
| 289,384 | A | * | 12/1883 | Byrkit | 248/454 |
| 805,074 | A | * | 11/1905 | Kemp | 108/141 |
| 1,114,948 | A | * | 10/1914 | Walker | 108/5 |
| 2,026,011 | A | * | 12/1935 | Wright | 108/141 |
| 2,535,112 | A | * | 12/1950 | Woody | 312/233 |

(Continued)

FOREIGN PATENT DOCUMENTS

| | | | |
|---|---|---|---|
| WO | WO 2011/049458 | A1 | 4/2011 |
| WO | WO 2011/049460 | A1 | 4/2011 |

OTHER PUBLICATIONS

Stressless PC-table; http://www.ekornes.com/us/stressless-recliners/tables/stressless-pc-table, 1 sheet; Undated but accessed on Apr. 16, 2014.

(Continued)

*Primary Examiner* — Milton Nelson, Jr.
(74) *Attorney, Agent, or Firm* — Christie, Parker & Hale, LLP

(57) ABSTRACT

A computer component mounting apparatus configured to be coupled to a chair and to support a computer component, such as a laptop, a computer monitor, or a keyboard. The computer component mounting apparatus includes a mounting post defining a swing axis, an elbow including a vertical leg and a horizontal leg, a swing arm assembly, and a deck tilt mount. The vertical leg of the elbow is rotatably coupled to the mounting post about the swing axis. The swing arm assembly is rotatably coupled to the horizontal leg of the elbow about a tilt axis. The deck tilt mount is rotatably coupled to the swing arm assembly about a pitch axis. A keyboard support, a computer monitor support assembly, or a laptop table may be coupled to the deck tilt mount.

21 Claims, 35 Drawing Sheets

(56) References Cited

U.S. PATENT DOCUMENTS

| | | | | |
|---|---|---|---|---|
| 5,605,311 | A | 2/1997 | McGrath et al. | |
| 5,653,499 | A * | 8/1997 | Goodall | 297/170 |
| 5,816,648 | A * | 10/1998 | Baccili et al. | 297/159.1 |
| 6,145,800 | A | 11/2000 | Watkins | |
| 7,478,867 | B2 | 1/2009 | Weng | |
| D655,532 | S | 3/2012 | Saelid | |
| 2008/0121763 | A1 | 5/2008 | Mori et al. | |
| 2008/0302938 | A1 * | 12/2008 | Goodwin et al. | 248/288.51 |

OTHER PUBLICATIONS

Photograph of Ecornes Laptop Table, 1 sheet; Date Unknown.
Catalog Page of Stressless Royal Chair, 1 sheet; Date Unknown.
Advertisement from www.horizontalcomputing.com; 1 sheet; Date Unknown.

* cited by examiner 23
36
37
38
39
40
41
42
45
50
51
15C

FIG. 16A
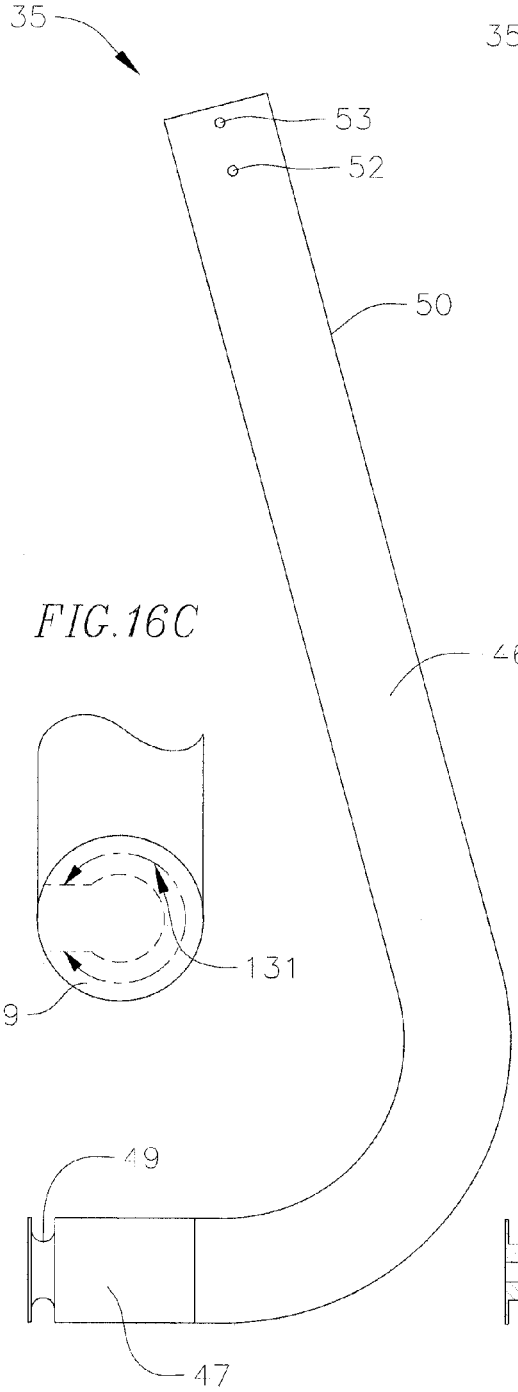
FIG. 16B
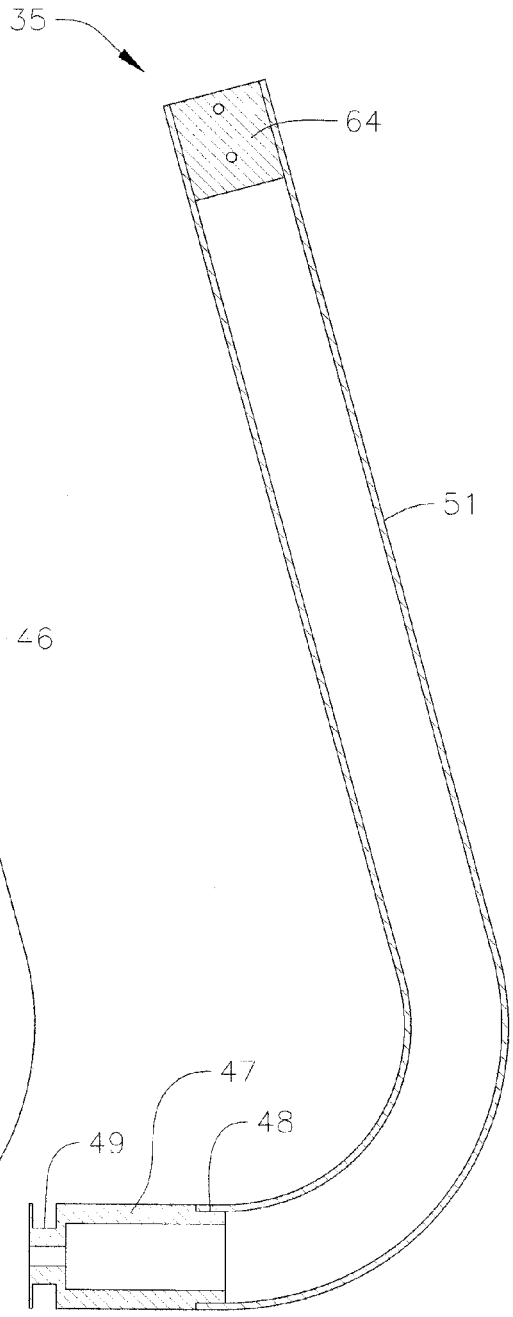
FIG. 16C

COMPUTER COMPONENT MOUNTING DEVICE FOR A CHAIR

CROSS-REFERENCE TO RELATED APPLICATION

This application is a continuation-in-part of U.S. patent application Ser. No. 13/306,932, filed Nov. 29, 2011, now U.S. Pat. No. 8,870,280, issued Oct. 28, 2014, the entire content of which is incorporated herein by reference.

FIELD

The present disclosure relates generally to computer component mounting devices and, more particularly, to articulable computer component mounting devices for reclinable chairs.

BACKGROUND

Reclinable chairs are commonly used for providing a more comfortable or ergonomic position to the back and/or legs of a user while the user is seated. Typically, reclinable chairs are used in a home, but may also be used in an office or other location. For example, during rehabilitation, a worker may be able to work more efficiently in a reclined position. As such, a user of a reclinable chair may wish to use a computer (e.g., a laptop computer ("laptop")) or a computer component (e.g., a computer monitor, a keyboard, or a mouse) while seated in the chair. However, it may be difficult or uncomfortable to use the computer and/or the computer component while seated in a typical reclinable chair because a typical reclinable chair does not have a table for supporting the computer and/or the computer component, and, therefore, a user would likely place the computer component in his or her lap or precariously balance the computer component on an armrest of the chair.

SUMMARY

The present disclosure is directed to computer component mounting apparatus configured to support a computer component, such as a computer monitor, a keyboard, a mouse, and/or a laptop. In one embodiment, the computer component mounting apparatus includes a mounting post defining a swing axis configured to be coupled to a chair. The computer component mounting apparatus also includes an elbow having a vertical leg and a horizontal leg. The vertical leg is rotatably coupled to the mounting post about the swing axis. The horizontal leg of the elbow defines a tilt axis. The computer component mounting apparatus further includes a swing arm assembly having a proximal end rotatably connected to the horizontal leg of the elbow about the tilt axis. The computer component mounting apparatus also includes a deck tilt mount rotatably coupled to a distal end of the swing arm assembly about a pitch axis and a keyboard support coupled to the deck tilt mount. The keyboard support includes a base plate and a support plate slidably coupled to the base plate. The base plate may be fixedly coupled to the deck tilt mount. The support plate may define a pair of opposing channels in which the base plate is slidably received. The keyboard support may include at least one hook or loop-type fastener coupled to an upper surface of the support plate configured to detachably engage at least one corresponding loop or hook-type fastener coupled to a keyboard. The swing arm assembly may include a series of segments hingedly coupled to each other. The computer component mounting apparatus may also include a mounting bracket coupled to the mounting post and configured to couple the computer component mounting apparatus to the chair. An upper end of the mounting post may include a recess configured to connectedly receive at least one utility device. The computer component mounting apparatus may also include at least one spacer ring on the mounting post and below the elbow to adjust a height of the keyboard support.

According to another embodiment of the present disclosure, a computer component mounting apparatus includes a mounting post defining a swing axis configured to be coupled to a chair. The computer component mounting apparatus also includes an elbow having a vertical leg and a horizontal leg. The vertical leg is rotatably coupled to the mounting post about the swing axis. The horizontal leg of the elbow defines a tilt axis. The computer component mounting apparatus further includes a swing arm assembly having a proximal end rotatably connected to the horizontal leg of the elbow about the tilt axis. The computer component mounting apparatus also includes a deck tilt mount rotatably coupled to a distal end of the swing arm assembly about a pitch axis and a computer monitor support assembly coupled to the deck tilt mount. The computer monitor support assembly includes a monitor support bracket coupled to a base support bracket. The computer monitor support assembly may include a splice bracket coupled to the monitor support bracket and the base support bracket. The monitor support bracket may be configured to slide relative to the splice bracket to adjust a height of the monitor support bracket. The monitor support bracket may include a series of openings configured to receive a series of fasteners coupling a computer monitor to the monitor support bracket. The swing arm assembly may include a series of segments hingedly coupled to each other. The computer component mounting apparatus may also include a mounting bracket coupled to the mounting post and configured to couple the computer component mounting apparatus to the chair. The computer component mounting apparatus may also include at least one spacer ring on the mounting post and below the elbow to adjust a height of the computer monitor support assembly.

According to another embodiment of the present disclosure, a computer component mounting apparatus includes a mounting post defining a swing axis configured to be coupled to a chair. The computer component mounting apparatus also includes an elbow having a vertical leg and a horizontal leg. The vertical leg is rotatably coupled to the mounting post about the swing axis. The horizontal leg of the elbow defines a tilt axis. The computer component mounting apparatus further includes an articulable swing arm assembly. A proximal end of the articulable swing arm assembly is rotatably connected to the horizontal leg of the elbow about the tilt axis. The articulable swing arm assembly includes a series of segments hingedly coupled to each other. The computer component mounting apparatus also includes a deck tilt mount rotatably coupled to a distal end of the articulable swing arm assembly about a pitch axis. The deck tilt mount is configured to support a computer component. The articulable swing arm assembly may include any desired number of segments, such as from two to ten segment. The articulable swing arm assembly may include four segments and the first segment of the articulable swing arm assembly may include an angled tube and each of the second, third, and fourth segments may include a straight tube. The computer component mounting apparatus also include a keyboard support, a computer monitor support assembly, or a laptop table coupled to the deck tilt mount. The computer component mounting apparatus may also include a knob set screw coupled to the vertical leg of the elbow. Adjustment of the knob set screw increases or decreases the force required to rotate the elbow about the swing axis. The computer component mounting apparatus may also include an outer circumferential notch in the proximal end of the articulable swing arm assembly and a leveling set screw coupled to the horizontal leg of the elbow and configured to engage the outer circumferential notch in the articulable swing arm assembly to set a level of the articulable swing arm assembly about the tilt axis. The computer component mounting apparatus may also include at least one set screw coupled to the deck tilt mount. Adjustment of the at least one set screw increases or decreases the force necessary to rotate the deck tilt mount about the pitch axis.

This summary is provided to introduce a selection of concepts that are further described below in the detailed description. This summary is not intended to identify key or essential features of the claimed subject matter, nor is it intended to be used in limiting the scope of the claimed subject matter.

BRIEF DESCRIPTION OF THE DRAWINGS

The above and other features and advantages will become more apparent to those of ordinary skill in the art by describing in detail some exemplary embodiments of the present invention with reference to the attached drawings, in which:

FIGS. 16A, 16B, and 16C are a top view, cross-sectional view, and a side view of the swing arm assembly, respectively;

DETAILED DESCRIPTION

Some exemplary embodiments will now be described more fully hereinafter with reference to the accompanying drawings; however, embodiments of the present invention may be embodied in different forms and should not be construed as limited to the exemplary embodiments illustrated and set forth herein. Rather, these exemplary embodiments are provided by way of example for understanding of the invention and to convey the scope of the invention to those skilled in the art.

Figure 1:
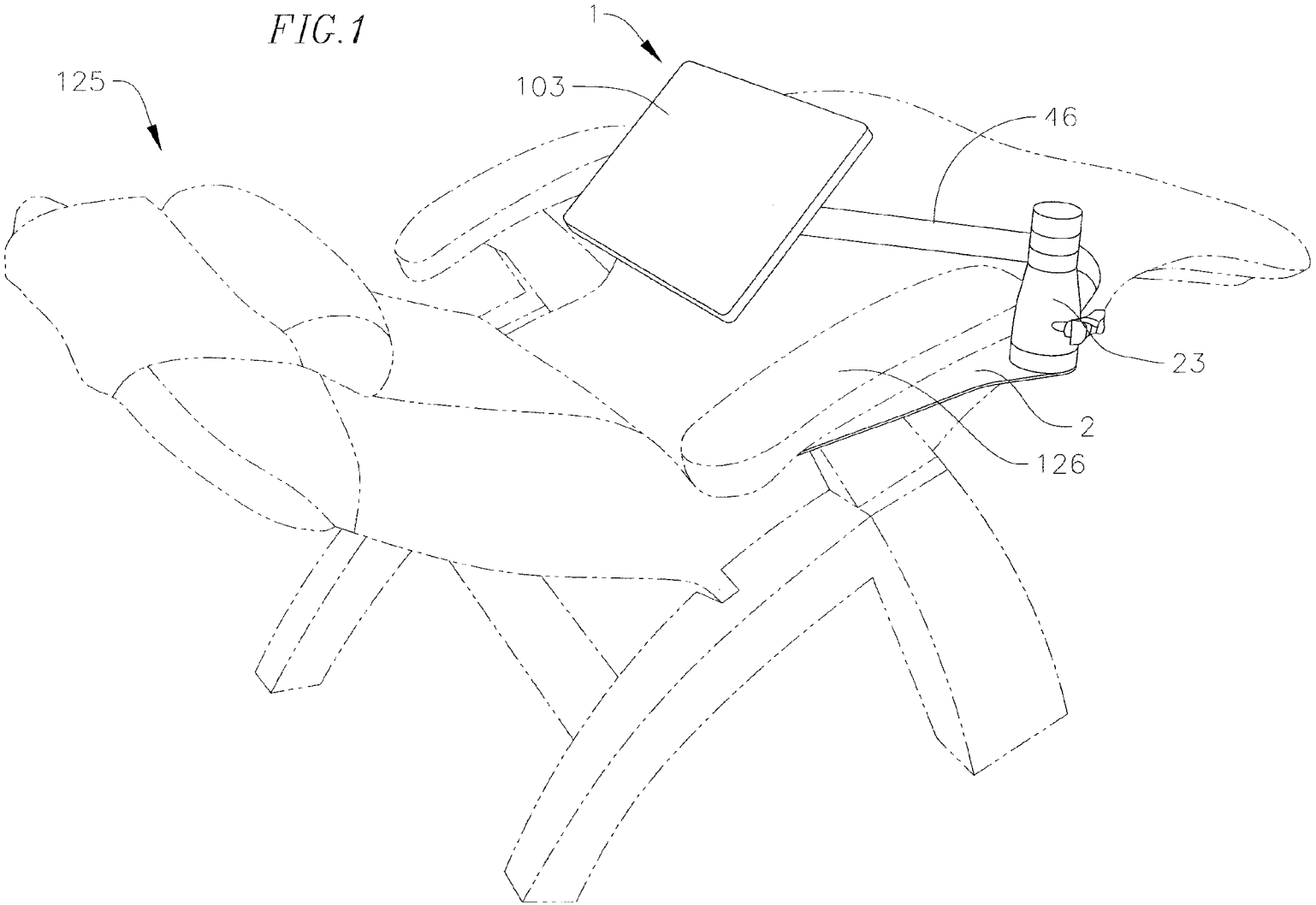
FIG. 1 is a perspective view of a laptop table assembly mounted to a recliner chair according to an embodiment of the present invention.

With reference to FIG. 1, a laptop table assembly 1 is connected to an armrest support 126 of a recliner chair 125. FIGS. 5, 6, 7, 8, and 9 illustrate an embodiment of the laptop table assembly 1 with multiple components that are rotatably or hingedly connected to each other. The laptop table assembly 1 comprises a laptop table 103 (FIGS. 5, 6, 7, 8, and 9) configured to adjustably mount on a hinge 75 (FIGS. 6, 8, and 9), a swing arm 46 (FIGS. 5, 6, 7, 8, and 9) configured to rotatably attach to the hinge 75 and a horizontal leg 37 of an elbow 23 (FIGS. 5, 6, 7, 8, and 9), and a mounting post 8 (FIG. 9) configured to rotatably attach to a vertical leg 36 of the elbow 23 and fixedly attach to a mounting bracket 2 (FIGS. 5, 6, 7, 8, and 9), which in turn is configured to attach to the recliner chair 125.

Figure 10B:
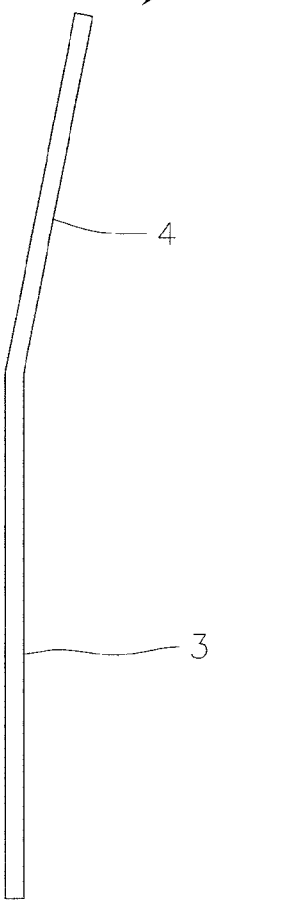
FIGS. 10A and 10B are a top view and a side view of the mounting bracket, respectively.
Figure 10A:
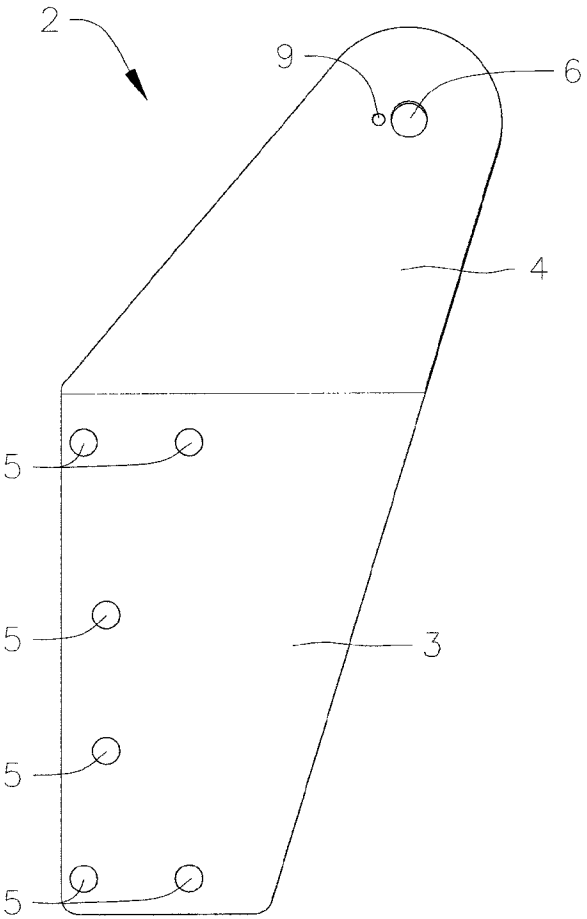
Figure 11A:
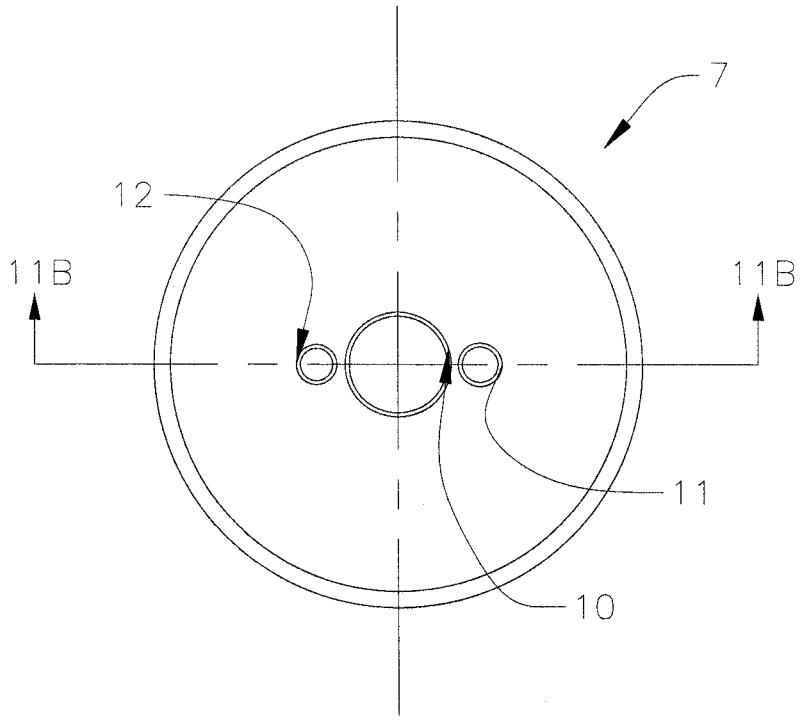
FIGS. 11A and 11B are a top view and a cross-sectional view of the spacer plate, respectively.
Figure 11B:
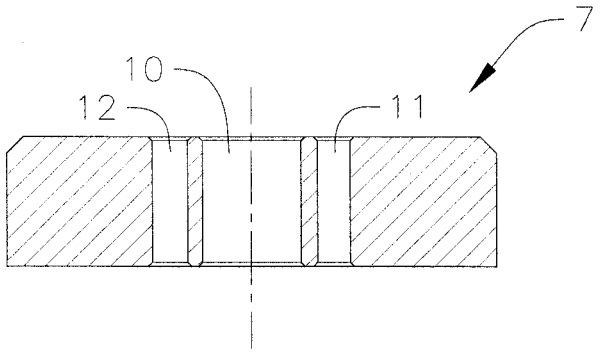

As shown in FIGS. 10A and 10B, the mounting bracket 2 contains two flat plate segments 3, 4 disposed at an angle relative to each other. The first flat plate segment 3 contains a pattern of holes 5 configured to align with preexisting holes (not shown) in the armrest support 126 of the recliner chair 125. The mounting bracket 2 is secured to the recliner chair 125 by any suitable means, for example, a plurality of screws (not shown) extending through the holes 5 in the mounting bracket 2 and into the preexisting holes in the armrest support 126. With continued reference to FIG. 10, the second flat plate segment 4 contains a hole 6 for attaching a spacer plate 7 and the mounting post 8 to the mounting bracket 2. The second flat plate segment 4 also contains a pin hole 9 adjacent to the hole 6 for fixing the angular position of the spacer plate 7 relative to the mounting bracket 2.

Figure 9:
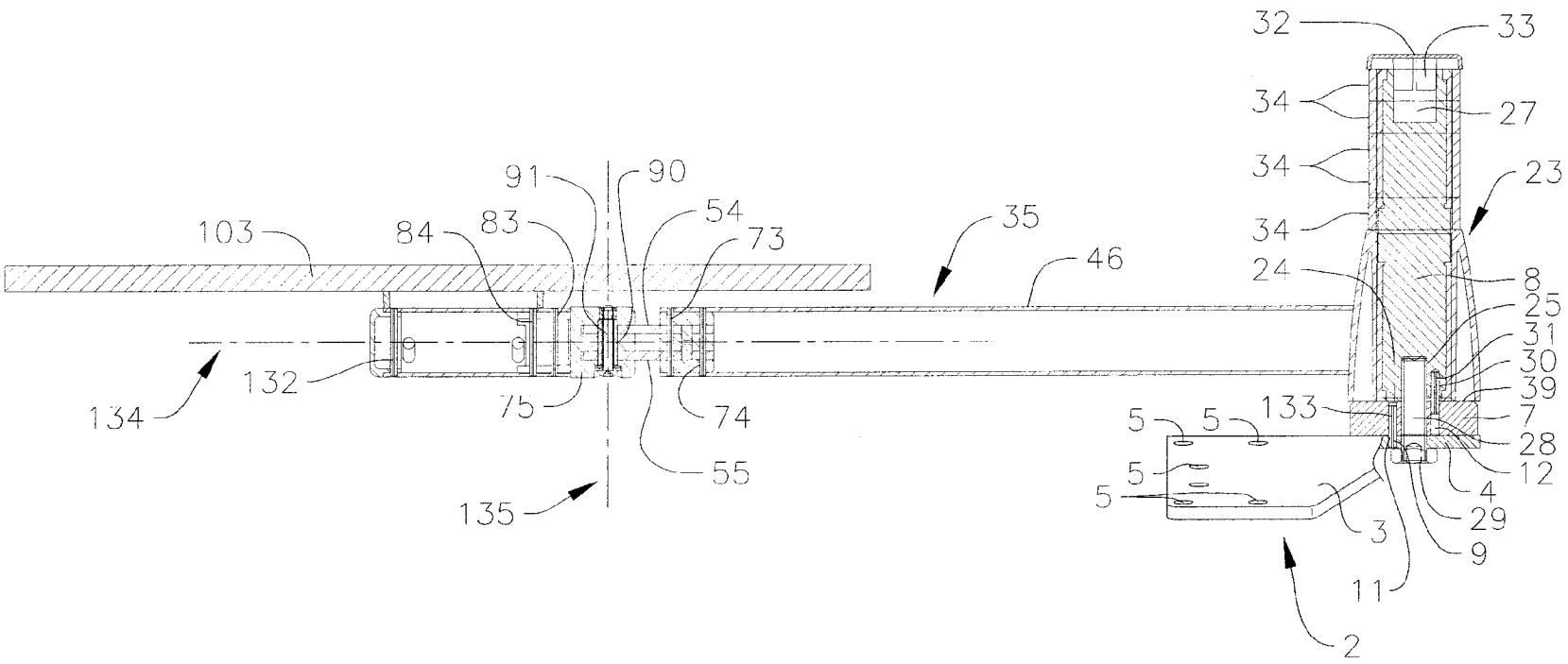
FIG. 9 is a cross-sectional view of the laptop table assembly.

As shown in FIGS. 6, 7, 9, 11A, and 11B, the spacer plate 7 is provided to mount the mounting post 8 to the mounting bracket 2. The spacer plate 7 is a flat disk containing an axial smooth bore 10 configured to align with the hole 6 in the mounting bracket 2. The spacer plate 7 also contains two off-axis pin holes 11, 12 adjacent to the hole 6, which are configured to prevent the spacer plate 7 and mounting post 8, respectively, from rotating about their longitudinal axes. As illustrated in FIG. 9, the angular position of the spacer plate 7 is fixed by aligning an off-axis pin hole 11 in the spacer plate 7 with the pin hole 9 in the mounting bracket 2 and by inserting any suitable mechanical fastener, such as an anti-rotation pin 133, through the off-axis pin hole 11 in the spacer plate 7 and the pin hole 9 in the mounting bracket 2. In an alternative embodiment, the angular position of the spacer plate 7 is fixed to the mounting bracket 2 by a countersunk head rivet (not shown) extending through the off-axis pin hole 11 and the pin hole 9.

Figure 12A:
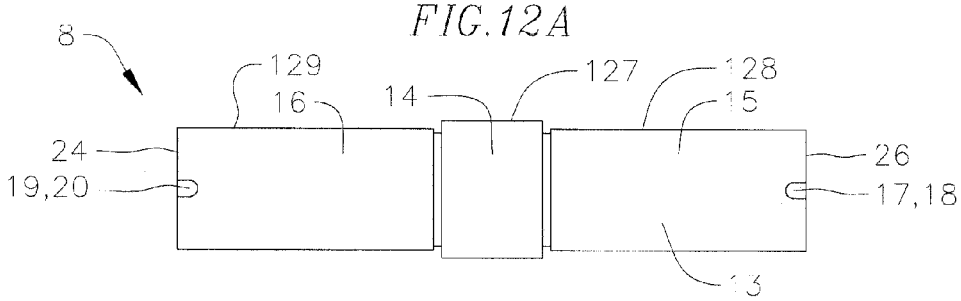
FIGS. 12A, 12B, and 12C are a side view, bottom view, and a cross-sectional view of the mounting post, respectively.
Figure 12B:
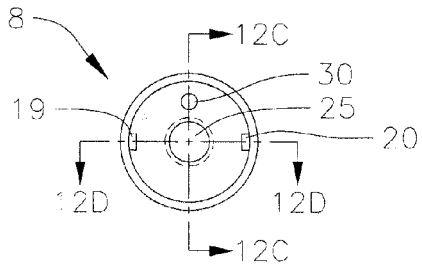
Figure 12C:
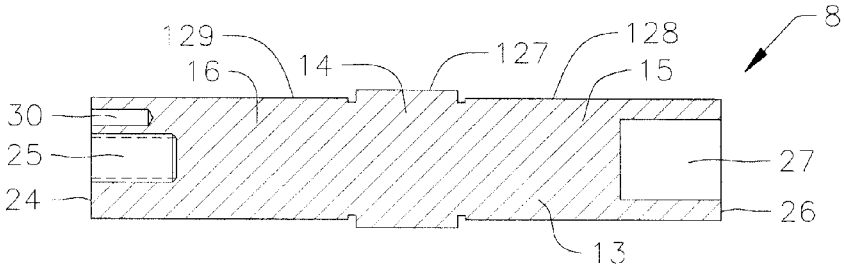
Figure 12D:
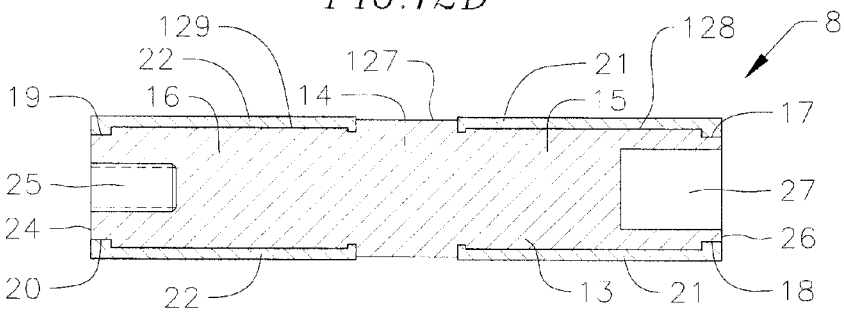
FIG. 12D is a cross-sectional view of the mounting post along with the molding.
Figure 13A:
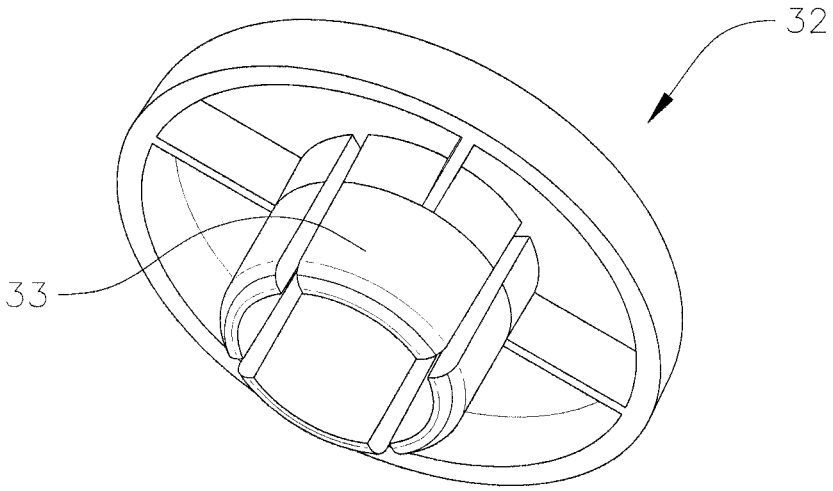
FIGS. 13A and 13B are a perspective view and a side view of the top cap, respectively.
Figure 13B:
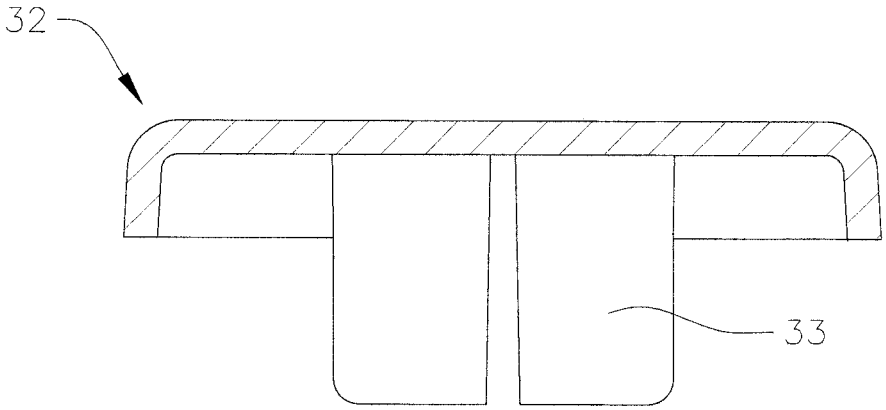

Referring now to FIGS. 12A, 12B, 12C, and 12D, a mounting post 8 comprises a rod 13 having an outer diameter 127 that is largest in a central portion 14 of the mounting post 8 and outer diameters 128, 129 that are smaller at upper and lower portions 15, 16, respectively, of the mounting post 8. The upper and lower portions 15, 16 of the mounting post 8 each contain two outer circumferential notches 17, 18, 19, and 20. As illustrated in FIG. 12D, moldings 21, 22 are attached to the upper and lower portions 15, 16, respectively, of the mounting post 8 and extend into the outer circumferential notches 17, 18, 19, and 20. The moldings 21, 22 are applied to the upper and lower portions 15, 16 of the mounting post 8 by any suitable means, such as dipping, spraying, press fitting, or bonding. The outer circumferential notches 17, 18, 19, 20 prevent the moldings 21, 22 from rotating about the longitudinal axis of the mounting post 8 and thereby disengaging the mounting post 8. The moldings 21, 22 advantageously protect the mounting post 8 and the elbow 23, described in detail below, against premature wear which would otherwise result from the rotational contact between the elbow 23 and the mounting post 8.

With continued reference to FIGS. 12B, 12C, and 12D, a bottom surface 24 of the mounting post 8 contains an internally threaded blind bore 25 and a top surface 26 of the mounting post 8 contains a smooth blind bore 27. With additional reference to FIG. 9, an externally threaded shaft 28 connects the mounting post 8 to the spacer plate 7 and the mounting bracket 2. The externally threaded shaft 28 engages the internally threaded blind bore 25 and protrudes downward from the bottom surface 24 of the mounting post 8. The externally threaded shaft 28 is configured to extend through the smooth bore 10 in the spacer plate 7 and the hole 6 in the mounting bracket 2. The length of the portion of the externally threaded shaft 28 extending past the bottom surface 24 of the mounting post 8 sufficiently exceeds the combined thickness of the spacer plate 7 and the mounting bracket 2 to permit a self-locking hex nut 29 to engage the externally threaded shaft 28 and secure the mounting post 8 to the spacer plate 7 and the mounting bracket 2. In an alternative embodiment, a hex bolt having a grip length substantially equal to the combined thickness of the spacer plate 7 and the mounting bracket 2 may be used instead of the externally threaded shaft 28 and the self-locking hex nut 29.

Referring again to FIGS. 9, 12B, 12C, and 12D, the bottom surface 24 of the mounting post 8 contains an off-axis blind hole 30. The off-axis blind hole 30 is configured to align with the other off-axis pin hole 12 in the spacer place 7, and any suitable attachment member, such as an anti-rotation pin 31, is inserted into the off-axis blind hole 30 in the mounting post 8 and the off-axis pin hole 12 in the spacer plate 7 in order to prevent the mounting post 8 from rotating about its longitudinal axis. Otherwise, such longitudinal rotation of the mounting post 8 would cause the hex nut 29 securing the mounting post 8 and the spacer plate 7 to the mounting bracket 2 to disengage the externally threaded shaft 28.

Figure 6:
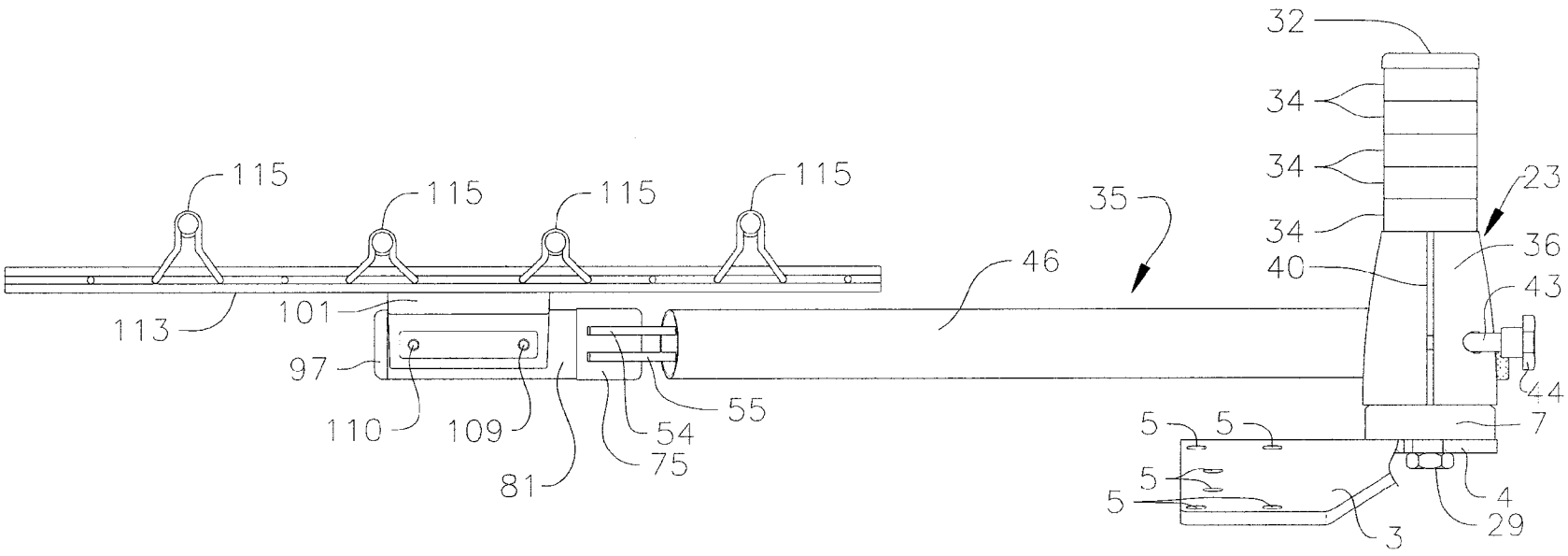
FIG. 6 is a back view of the laptop table assembly.
Figure 7:
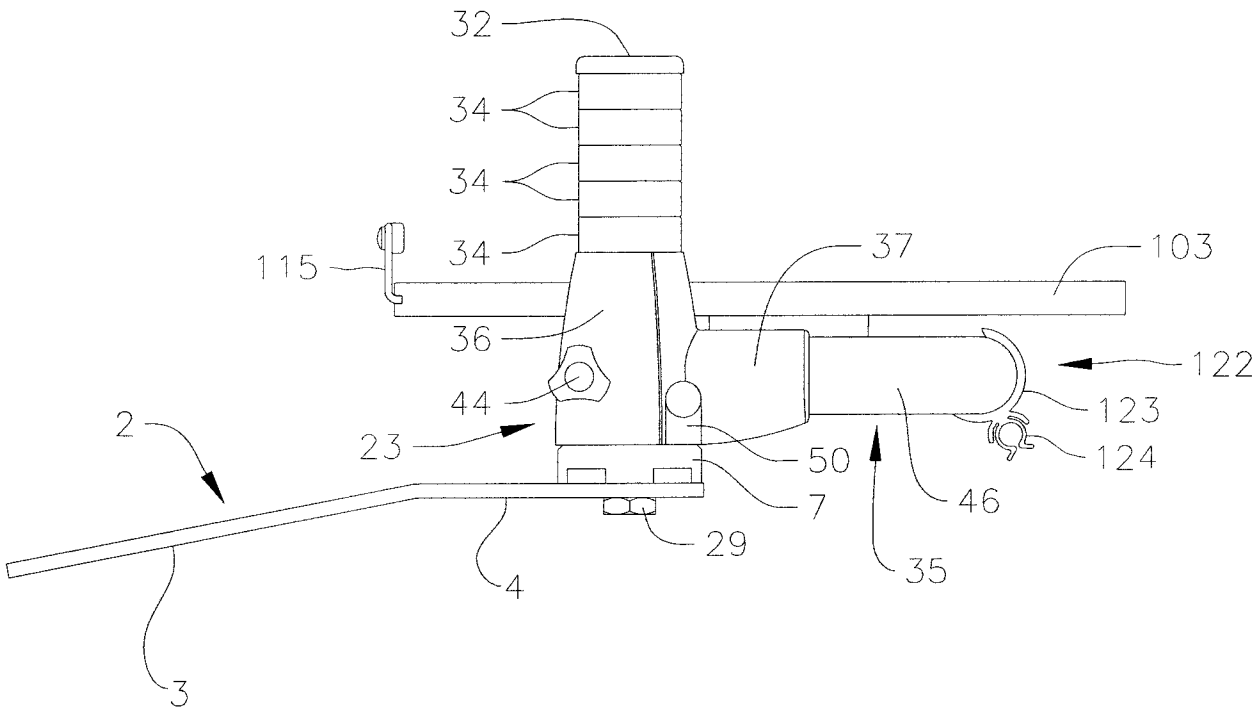
FIG. 7 is a side view of the laptop table assembly.

The smooth blind bore 27 in the top surface 26 of the mounting post 8 facilitates the attachment of various utility devices (not shown) such as a lamp, a secondary monitor, or a glass holder. As shown in FIGS. 6, 7, and 9, when a device is not attached to the mounting post 8, a top cap 32 may be attached to the mounting post 8 by press-fitting the cylindrical protrusion 33 on the top cap 32 into the smooth blind bore 27.

Figure 14A:
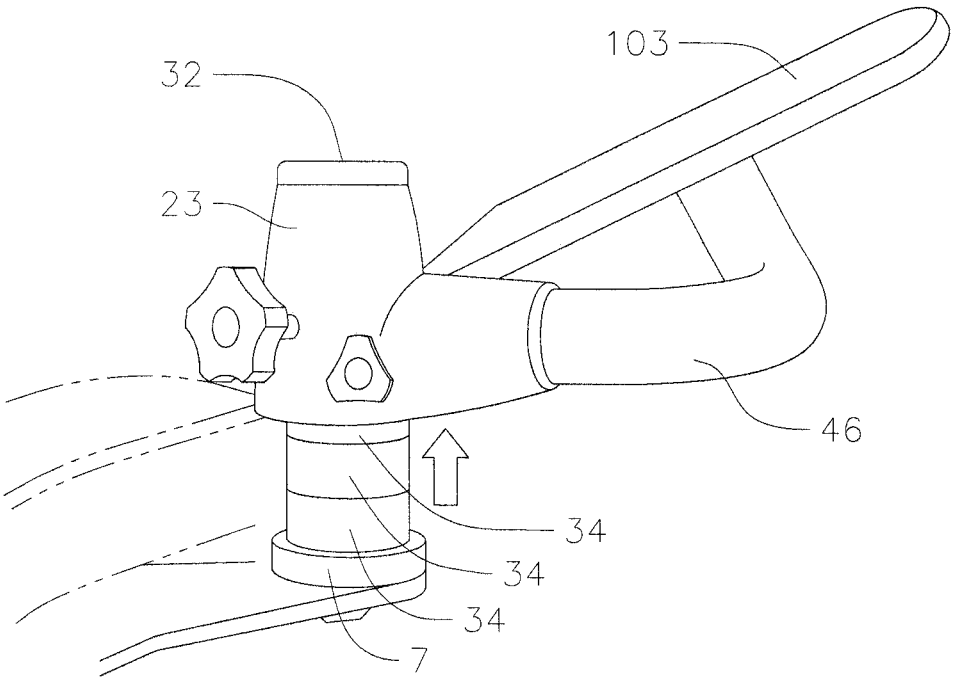
FIG. 14A is a side view of the laptop table assembly showing the spacer rings inserted between the elbow and the spacer plate in order to increase the overall height of the laptop table assembly.
Figure 14B:
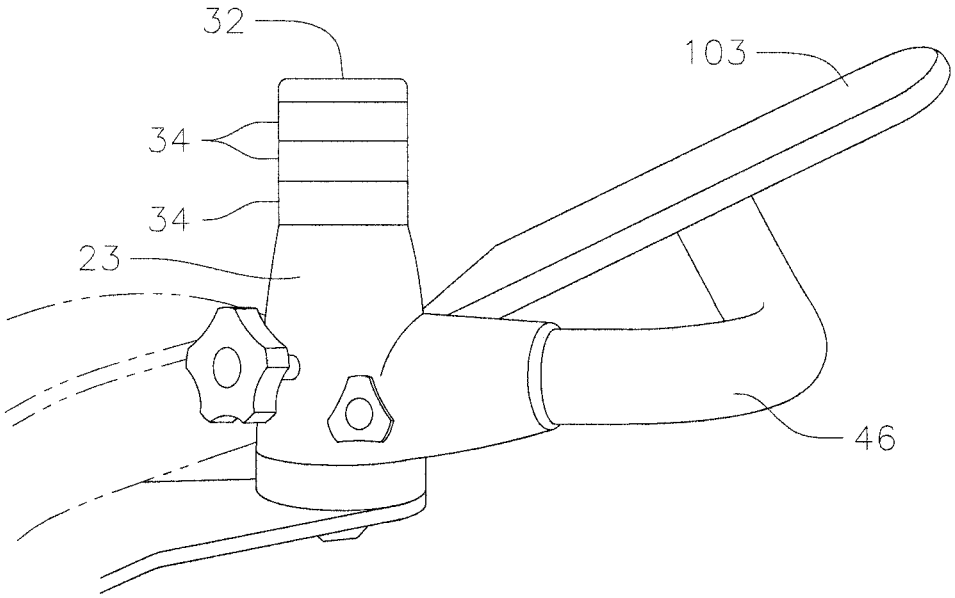
FIG. 14B is a side view of the laptop table assembly showing unused spacer rings stored on top of the elbow.
Figure 14C:
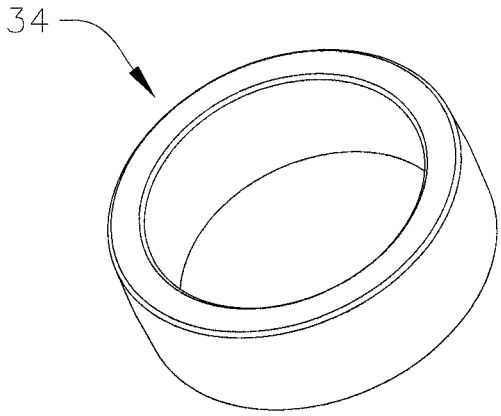
FIG. 14C is a perspective view of a spacer ring.

As depicted in FIGS. 14A and 14C, a plurality of spacer rings 34 are configured to slide onto the mounting post 8 and rest on top of the spacer plate 7. The spacer rings 34 adjust the overall height of the laptop table assembly 1 and thus increase the usable space between the recliner chair 125 and the laptop table assembly 1. Accordingly, a user selects the appropriate number of spacer rings 34 to accommodate the user's specific body type. In a preferred embodiment, three spacer rings 34 are provided and each spacer ring 34 is approximately 0.60 inches tall. In alternative embodiments, the number of spacer rings 34 and the height of each spacer ring 34 may vary to provide the user more or less refined control over the overall height of the laptop table assembly 1.

Figure 2A:
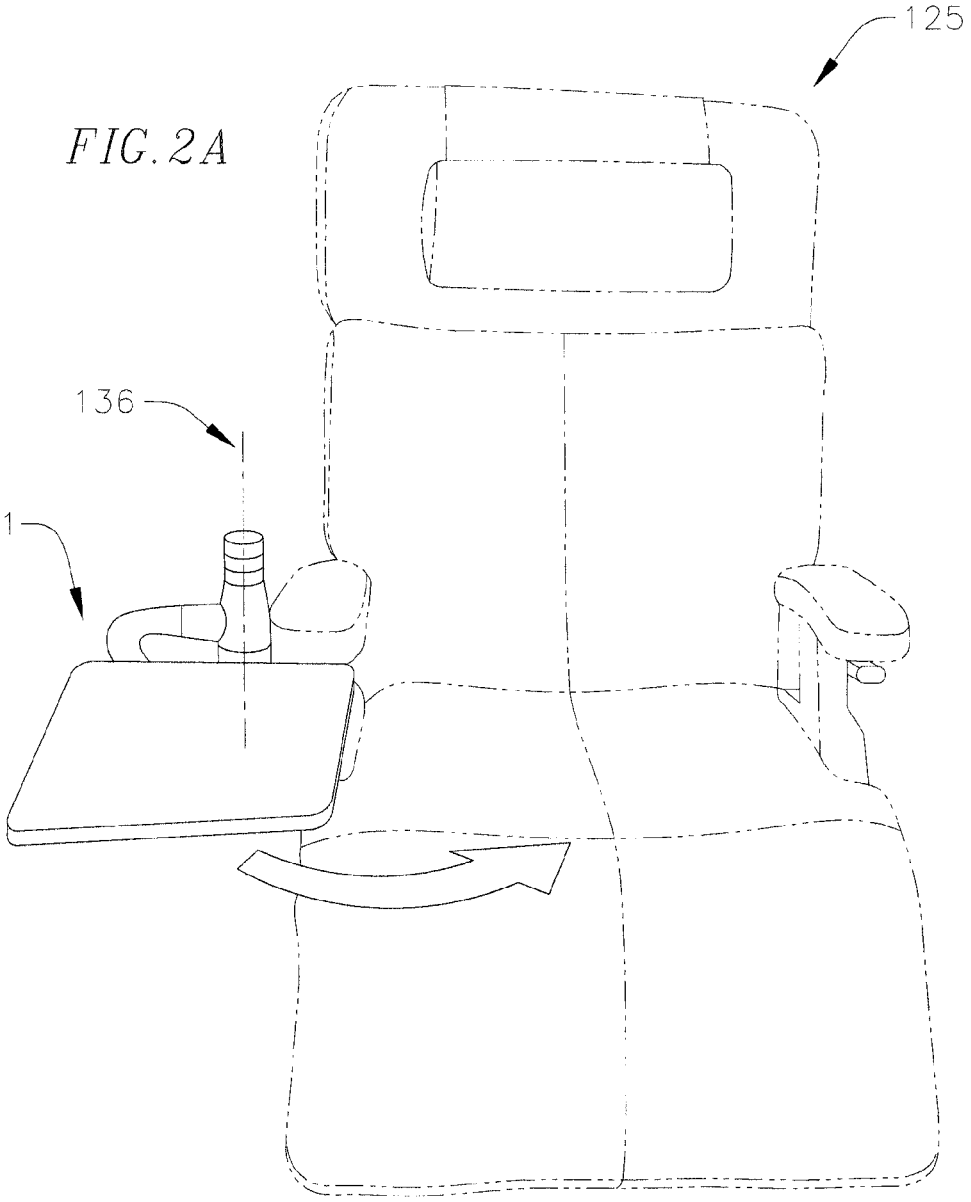
FIGS. 2A and 2B are a perspective view and a detail view, respectively, of the laptop table assembly mounted to a recliner chair showing the swinging capability of the laptop table assembly.
Figures 15A, 15B, 15C:
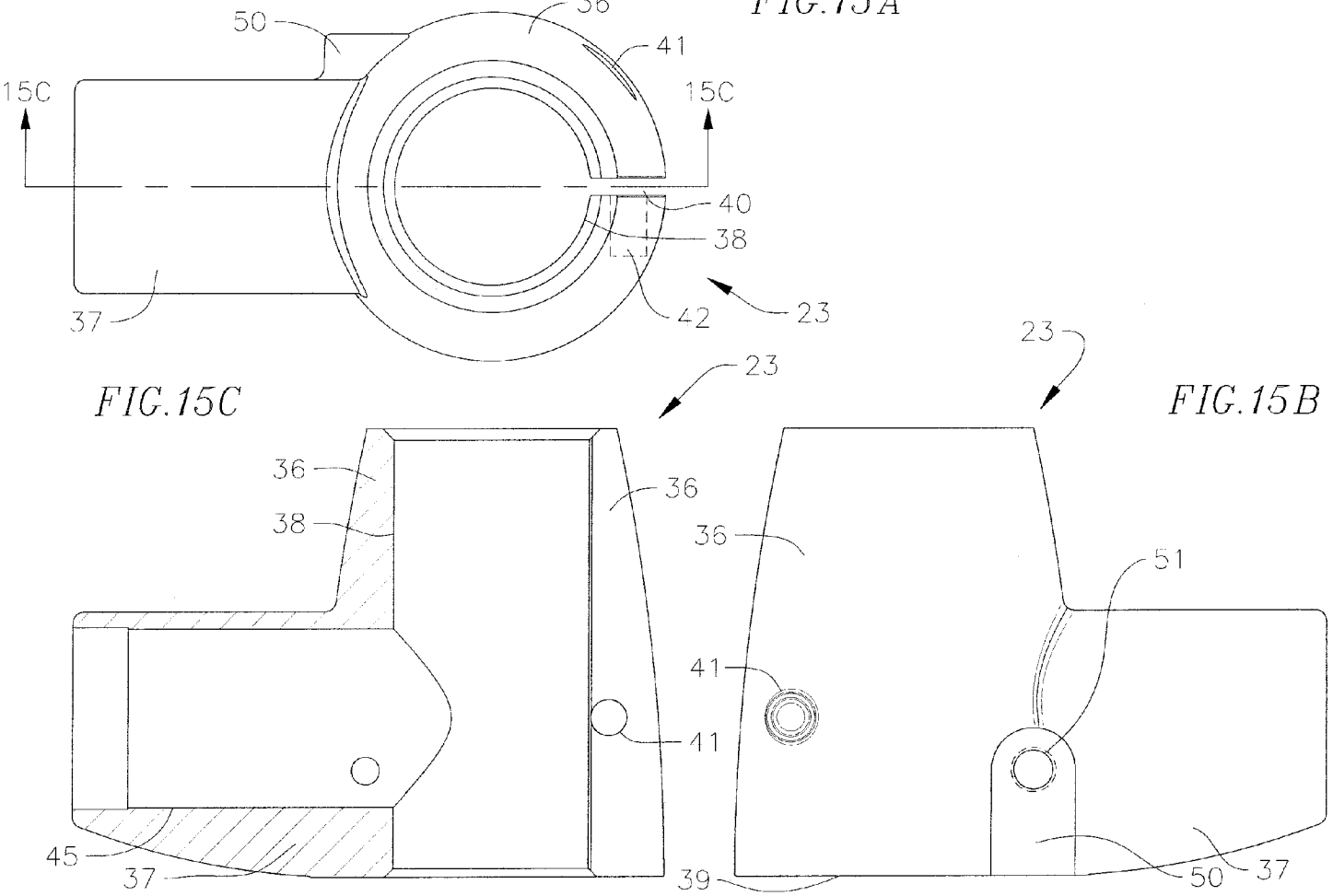
FIGS. 15A, 15B, and 15C are a top view, side view, and cross-sectional view of the elbow, respectively.

As shown in FIGS. 1, 5, 6, 7, 8, 9, the elbow 23 is provided to rotatably attach a swing arm assembly 35 to the mounting post 8 about a swing axis 136 (FIG. 2A). The elbow 23 comprises the vertical leg 36 and the horizontal leg 37. The vertical leg 36 is a frustum with a cylindrical opening 38 (FIG. 15A). The cylindrical opening 38 of the vertical leg 36 is configured to slide onto the outer surface of the mounting post 8 until a lower surface 39 of the vertical leg 36 rests on top of the spacer rings 34, if the user selected any, or on top of the spacer plate 7 if the user elected not to use any spacer rings 34. The vertical leg 36 permits the laptop table assembly 1 to rotate about the swing axis 136 extending through the centerline of the mounting post 8 and thereby swing out of the user's way for ingress and egress from the recliner chair or into the desired position for working with a laptop placed on the laptop table 103, as illustrated in FIG. 2A.

Figure 2B:
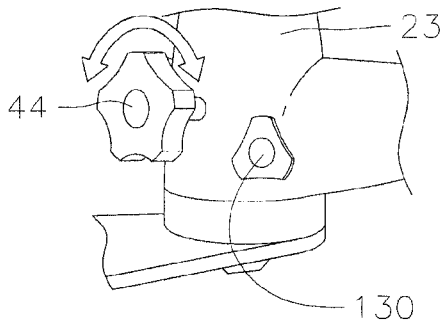
Figure 5:
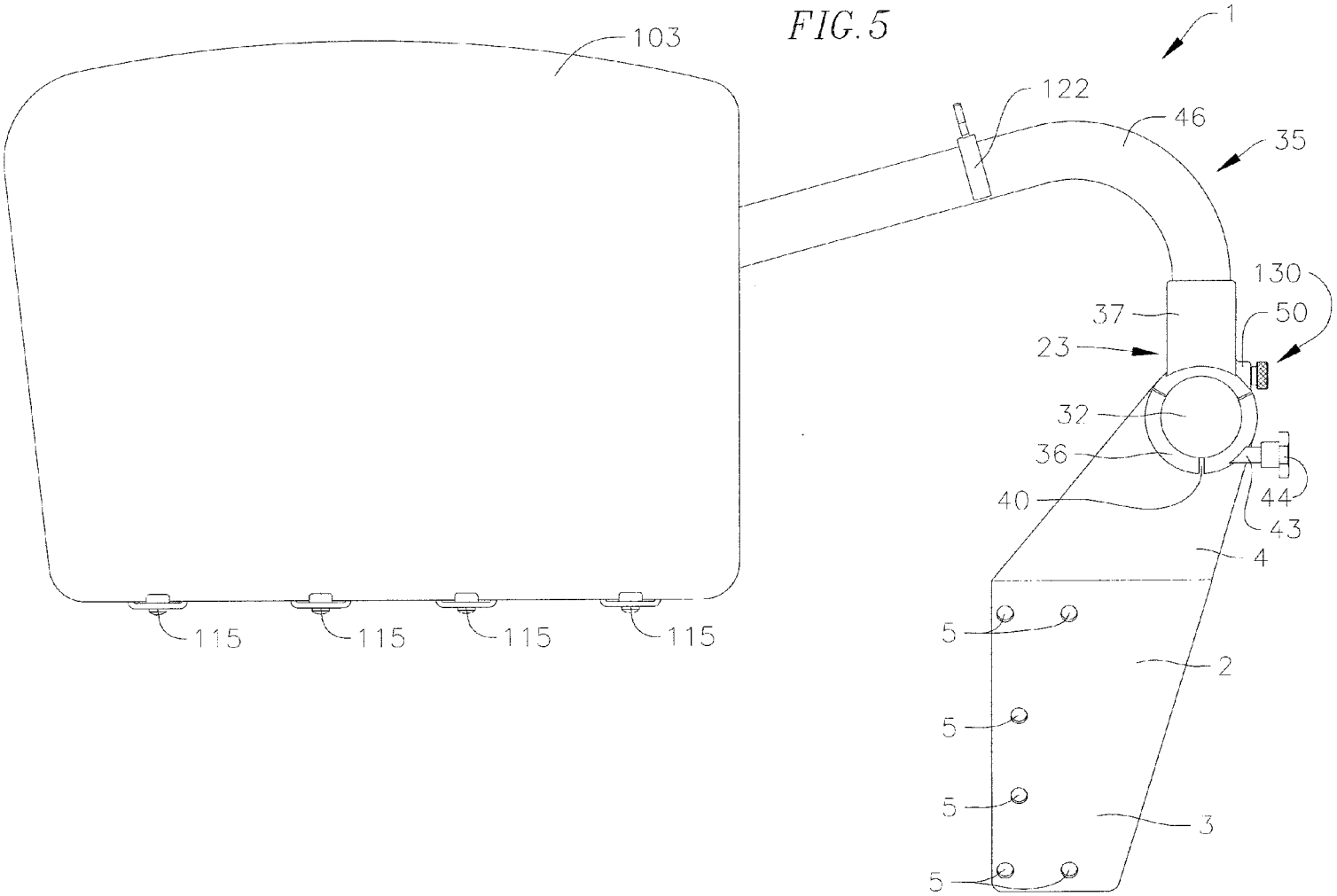
FIG. 5 is a top view of the laptop table assembly.

As illustrated in FIGS. 5, 6, and 15A, the vertical leg 36 of the elbow 23 also contains a narrow vertical slit 40 spanning the entire length of the vertical leg 36. The slit 40 permits the vertical leg 36 to circumferentially expand and contract around the mounting post 8, which decreases or increases the force necessary to swing the laptop table assembly 1 about the mounting post 8. The vertical leg 36 also contains a recessed opening 41 and an internally threaded bore hole 42, on opposite sides of the slit 40, which are configured to receive a threaded shaft 43 of a knob set screw 44. When the threaded shaft 43 of the knob set screw 44 is fully inserted into the recessed opening 41, the threaded shaft 43 orthogonally spans the slit 40 and engages the internally threaded bore hole 42. Adjusting the knob set screw 44 in the clockwise direction decreases the width of the slit 40 and thereby causes the vertical leg 36 to circumferentially contract around the mounting post 8. In contrast, adjusting the knob set screw 44 in the counterclockwise direction increases the width of the slit 40 and thereby causes the vertical leg 36 to circumferentially expand around the mounting post 8. Accordingly, as illustrated in FIG. 2B, the user adjusts the knob set screw 44 in either the clockwise or counterclockwise direction until the user achieves a desired amount of force necessary to swing the laptop table assembly 1 about the swing axis 136. In an alternative embodiment, the vertical leg 36 of the elbow 23 may contain one or more vertical notches (not shown) radially disposed on an outer surface of the vertical leg 36, which are configured to reduce the force necessary to contract the vertical leg 36 about the mounting post 8.

As illustrated in FIG. 14B, any unused spacer rings 34 may be stored on top of the vertical leg 36 of the elbow 23 by sliding the unused spacer rings 34 onto the mounting post 8 after the elbow 23 has been installed. The top cap 32 secured to the smooth blind bore 27 of the mounting post 8 ensures that the unused spacer rings 34 do not inadvertently disengage the mounting post 8.

Referring now to FIGS. 5, 7, 8, and 15C, the horizontal leg 37 of the elbow 23 comprises a cylindrical opening 45 configured to receive the proximal end of the swing arm assembly 35. As shown in FIGS. 16A and 16B, the swing arm assembly 35 comprises the tubular swing arm 46 and an attachment member 47. The swing arm 46 is an angular tube formed from any suitable material, such as aluminum, steel, or carbon fiber-reinforced polymer. In an exemplary embodiment, the swing arm 46 has a seventy-five degree bend. The distal end of attachment member 47 has a circumferential recess 48 that is press fit into the proximal end of the tubular swing arm 46 and is secured by any suitable means, such as welding.

Figure 3A:
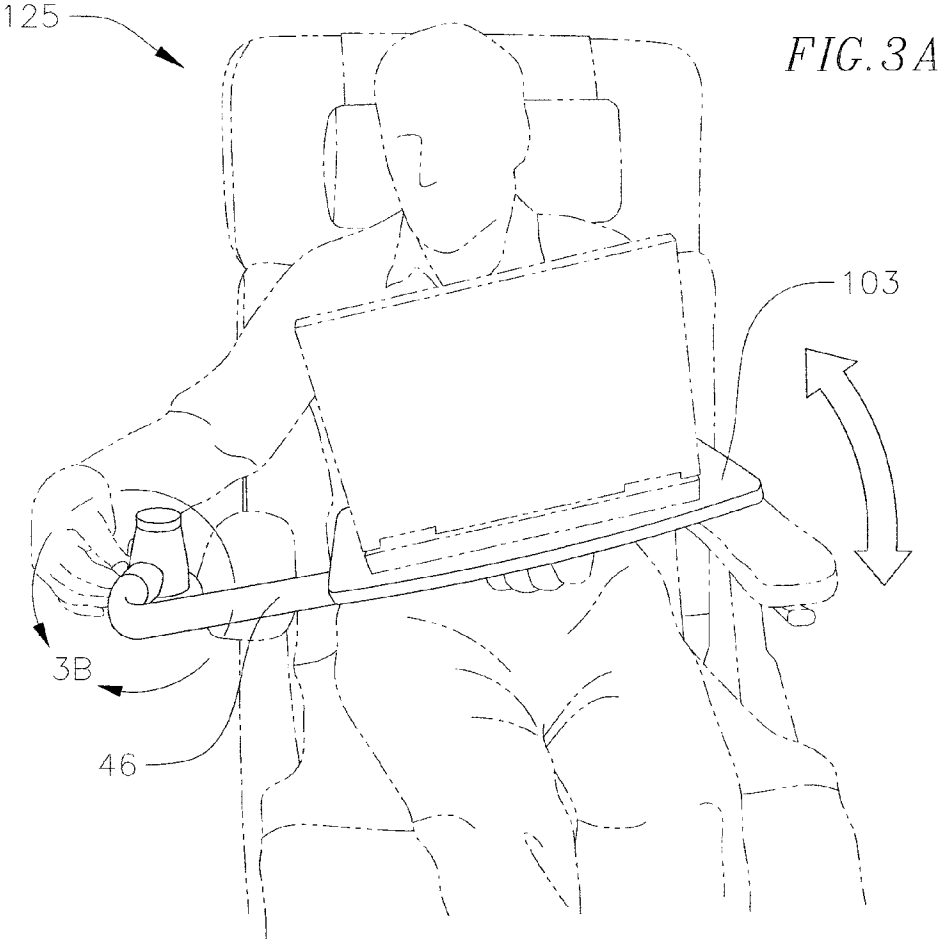
FIGS. 3A and 3B are a perspective view and a detail view, respectively, of the laptop table assembly mounted to a recliner chair showing the leveling capability of the laptop table assembly.
Figure 3B:
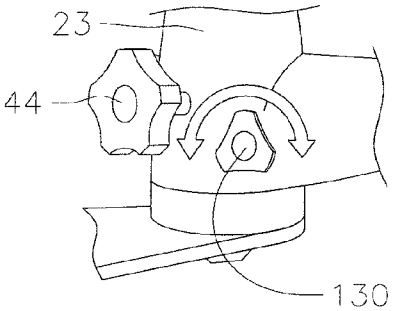

The proximal end of the attachment member 47, which extends into the cylindrical opening 45 in the horizontal leg 37 of the elbow 23, contains an outer circumferential notch 49 which permits the user to adjust the level of the laptop table assembly 1, as depicted in FIG. 3A. The level of the laptop table assembly 1 is adjustable to permit a user to compensate for the weight of an object, such as a laptop, placed on the laptop table 103 which tends to deflect the laptop table assembly 1 downward. Once the appropriate leveling angle is achieved, the user tightens a leveling set screw 130 to set the level of the swing arm assembly 35, as illustrated in FIG. 3B. Adjusting the leveling set screw 130 in the clockwise direction causes a threaded shaft (not shown) of the leveling set screw 130 to engage the outer circumferential notch 49 and thereby set the level of the laptop table assembly 1.

As a safety feature, however, even when the leveling set screw 130 is engaged with the outer circumferential notch 49, the laptop table assembly 1 is adapted to tilt past the set position in order to prevent pinning the user's legs between the recliner chair 125 and the laptop table assembly 1 if the recliner chair 125 is inadvertently reclined and the user's legs are forced upwards into the laptop table assembly 1. In fact, when the threaded shaft of the leveling set screw 130 is extended into the outer circumferential notch 49, the laptop table assembly 1 is configured to tilt to an angle corresponding to a span 131 of the outer circumferential notch 49. In an exemplary embodiment, the outer circumferential notch 49 spans approximately thirty degrees, which permits the laptop table assembly 1 to rotate approximately thirty degrees about the longitudinal axis of the horizontal leg 37 of the elbow 23. In an alternative embodiment, the outer circumferential notch 49 may span substantially more than thirty degrees, such as two hundred seventy degrees, in order to permit the laptop table assembly 1 to rotate into a stored configuration (not shown).

Additionally, as depicted in FIGS. 5, 7, 8, 15A, and 15B, the horizontal leg 37 of the elbow 23 contains a boss 50 with an axial bore 51 configured to receive the threaded shaft of the swivel set screw 130. In an alternative embodiment, a spacer (not shown) may be provided instead of incorporating a boss 50 into the horizontal leg 37 of the elbow 23.

Figure 8:
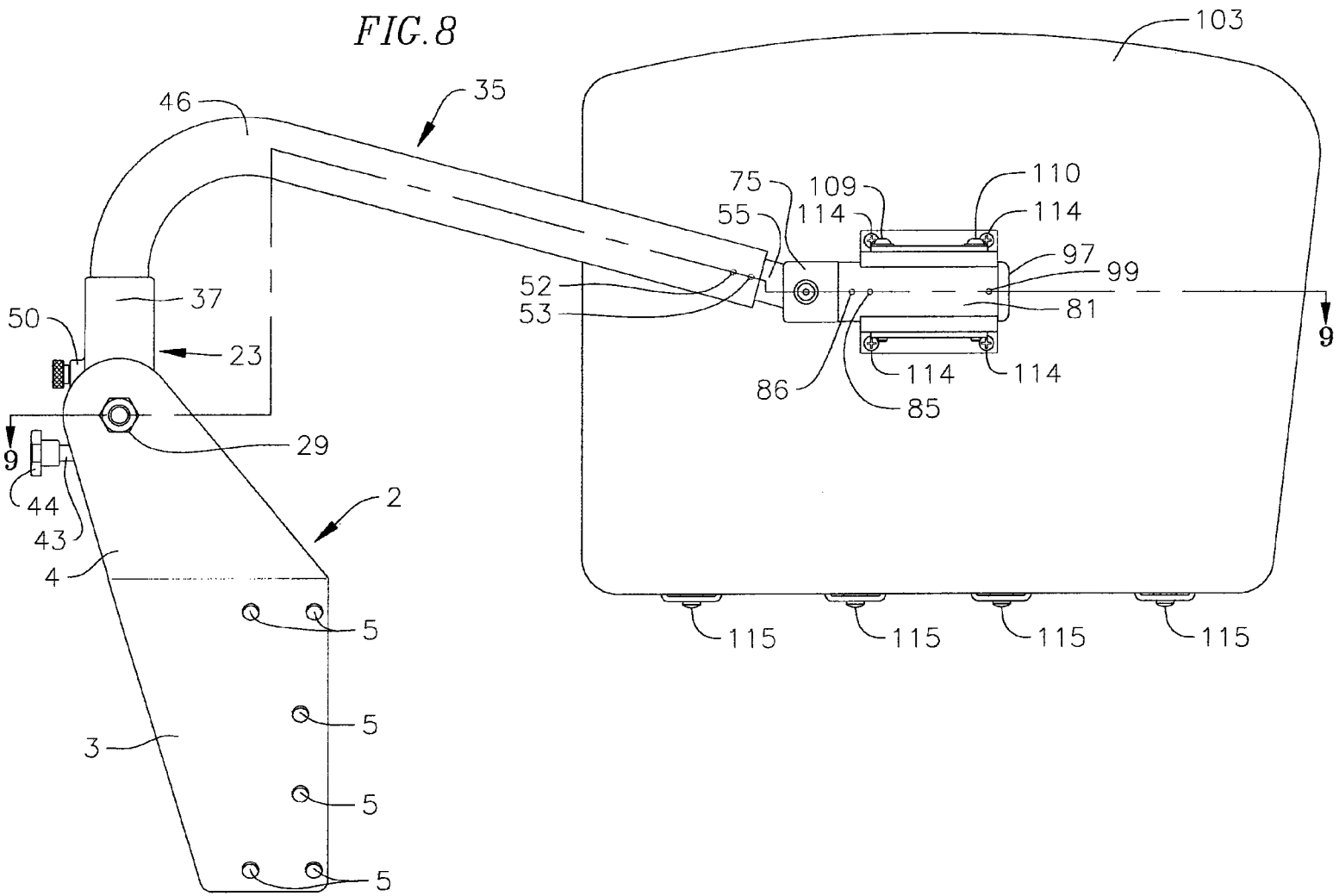
FIG. 8 is a bottom view of the laptop table assembly.
Figure 18:
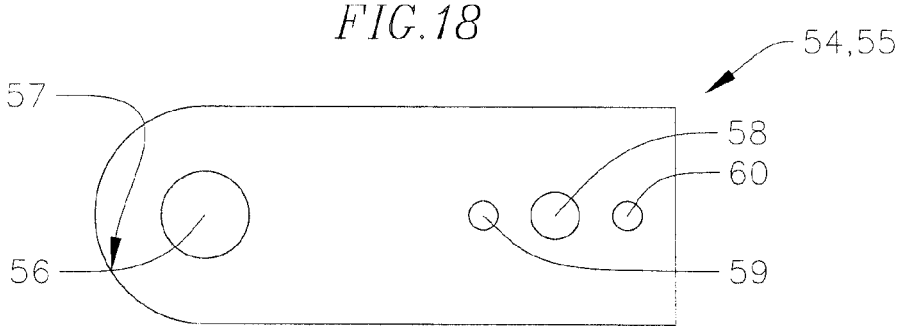
FIG. 18 is a top view of the upper and lower hinge blades.

As shown in FIGS. 6, 8, and 9, two hinge blades 54, 55 are configured to connect the distal end of the swing arm 46 to the proximal end of the hinge 75 which permits the user to swivel (FIG. 4) the laptop table assembly 1 about a swivel axis 135 (FIG. 9). As shown in FIG. 18, the hinge blades 54, 55 are flat plates with a pivot hole 56 and a rounded edge 57 on the distal end. The, proximal end of the hinge blades 54, 55 contain a mounting hole 58 and two pin holes 59, 60 on either side of the mounting hole 58.

Figure 17A:
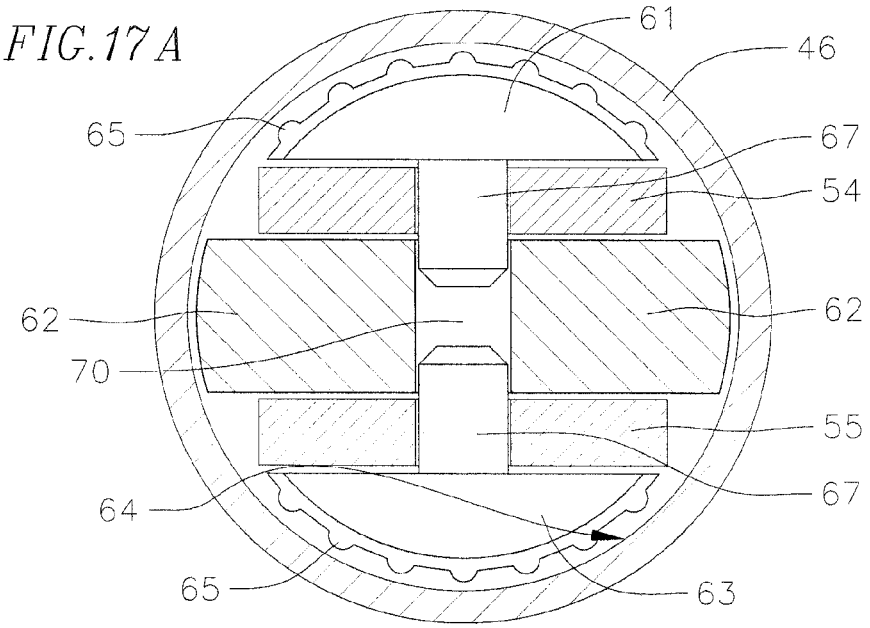
FIG. 17A is a cross-sectional view showing the hinge blades connected to the distal end of the swing arm by an upper hinge blade holder, a central hinge blade holder, and a lower hinge blade holder.
Figure 17B:
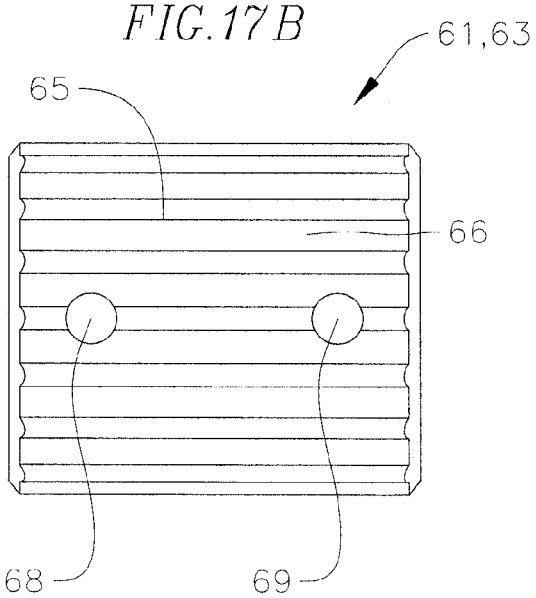
FIG. 17B is a top view of the upper and lower hinge blade holders.

Referring now to FIG. 17A, the proximal ends of the hinge blades 54, 55 are secured to the distal end of the swing arm 46 by an upper hinge blade holder 61, a central hinge blade holder 62, and a lower hinge blade holder 63. The upper and lower hinge blade holders 61, 63 are located between the outer wall 51 of the swing arm 46 and the upper and lower hinge blades 54, 55, respectfully. The upper and lower hinge blade holders 61, 63 are configured to engage an arcuate segment of an interior portion 64 of the distal end of the swing arm 46. The upper and lower hinge blade holders 61, 63 contain a series of longitudinal ridges 65 disposed on an outer surface 66 of the upper and lower hinge blade holders 61, 63 to facilitate engagement with the swing arm 46. The upper and lower hinge blade holders 61, 63 also contain a cylindrical post 67 configured to engage the mounting holes 58 in the proximal end of the hinge blades 54, 55 and thereby ensure the upper hinge blade 54 is aligned above the lower hinge blade 55. Additionally, as shown in FIGS. 8, 9, 17B, and 18, the upper and lower hinge blade holders 61, 63 contain two through holes 68, 69 configured to align with two through holes 52, 53 located in the outer wall 51 of the distal end of the swing arm 46 and the two pin holes 59, 60 located in the proximal end of the hinge blades 54, 55.

Figure 17C:
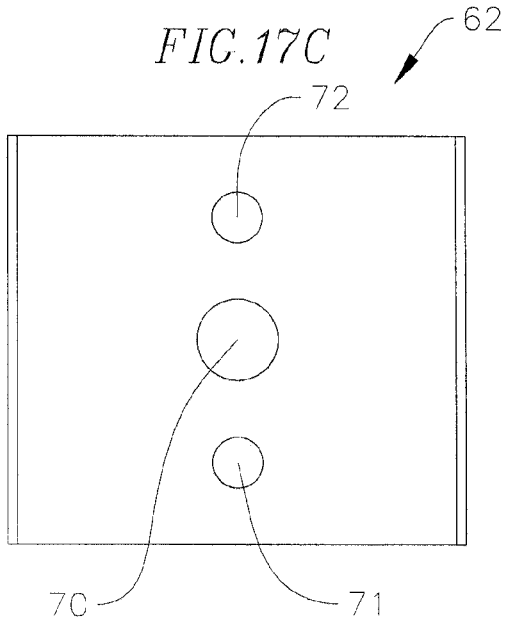
FIG. 17C is a top view of the central hinge blade holder.

With continued reference to FIG. 17A, the central hinge blade holder 62 is located between the upper and lower hinge blades 54, 55. Exterior portions of the central hinge blade holder 62 are configured to engage arcuate segments of the interior portion 64 of the distal end of the swing arm 46. The central hinge blade holder 62 has a central bore 70 configured to accept the cylindrical posts 67 on the upper and lower hinge blade holders 61, 63. Additionally, as shown in FIG. 17C, the central hinge blade holder 62 contains two through holes 71, 72 configured to align with the two through holes 68, 69 in the upper and lower hinge blade holders 61, 63, the two through holes 52, 53 located in the outer wall 51 of the distal end of the swing arm 46, and the two pin holes 59, 60 located on the proximal ends of the hinge blades 54, 55. Accordingly, the proximal ends of the hinge blades 54, 55 are attached to the distal end of the swing arm 46 by two pins 73, 74 extending through holes 52, 53 in the swing arm 46, holes 68, 69 in the upper hinge blade holder 61, holes 59, 60 in the upper hinge blade 54, holes 71, 72 in the central hinge blade holder 62, holes 59, 60 in the lower hinge blade 55, and holes 68, 69 in the lower hinge blade holder 63. The thickness of the central hinge blade holder 62 is substantially the same as the distance between two channels 76, 77 in the hinge 75 in order to ensure that the distance between the upper and lower hinge blades 54, 55 remains substantially constant between the distal ends and the proximal ends of the upper and lower hinge blades 54, 55.

Figure 19B:
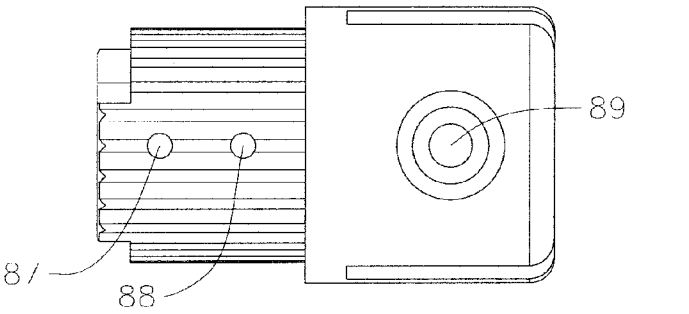
FIGS. 19A, 19B, and 19C are a perspective view, top view, and a side view of the hinge, respectively.
Figure 19C:
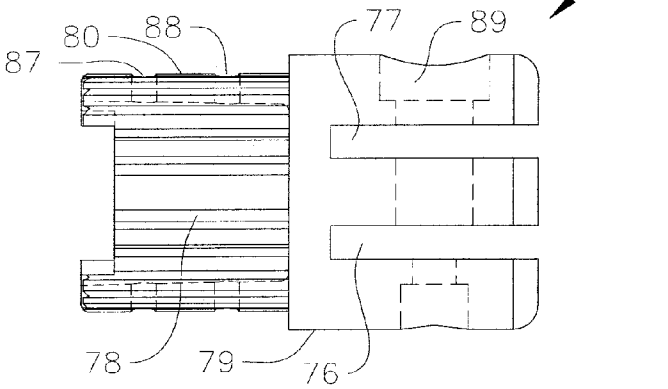
Figure 19A:
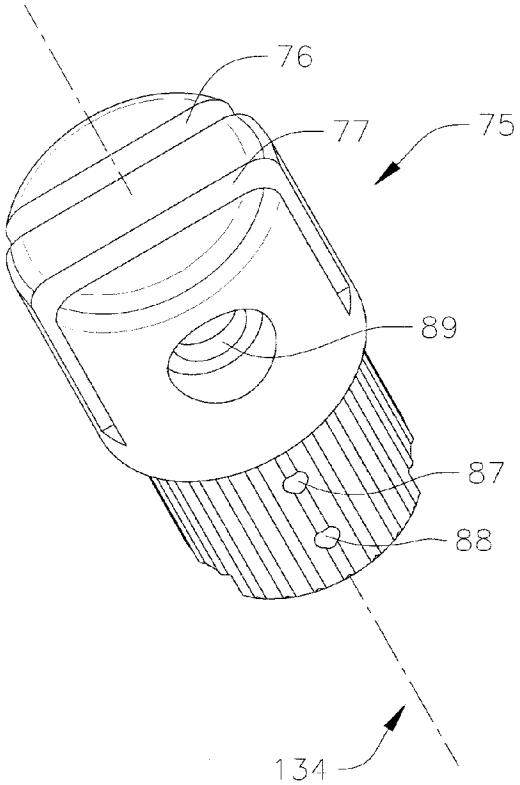

As depicted in FIGS. 19A, 19B, and 19C, the hinge 75 comprises a cylindrical rod 78 having an outer diameter 79 that is larger at its proximal end. The distal end of the hinge 75 has an outer diameter 80 substantially equal to an inner diameter 82 of a deck arm 81 in order to facilitate a press fit connection between the distal end of the hinge 75 and the deck arm 81, shown in FIGS. 20A, 20B, and 20C. Moreover, the distal end of the hinge 75 is secured to the deck arm 81 with two pins 83, 84 extending through holes 85, 86 in the proximal end of the deck arm 81 and holes 87, 88 in the distal end of the hinge 75. The proximal end of the hinge 75 contains the two channels 76, 77 configured to receive the distal ends of the hinge blades 54, 55. A through hole 89 in the hinge 75 aligns with the pivot holes 56 in the hinge blades 54, 55. The hinge 75 is rotatably secured to the hinge blades 54, 55 with a bushing 90 and a fastener 91. The rounded edges 57 on the hinge blades 54, 55 permit the hinge 75 to swivel about the swivel axis 135 (FIG. 4), which extends through the pivot holes 56 in the hinge blades 54, 55 and the through hole 89 in the hinge. Adjustment of the fastener 91 increases or decreases the amount of force required to swivel the laptop table assembly 1 about the swivel axis 135.

Figure 4:
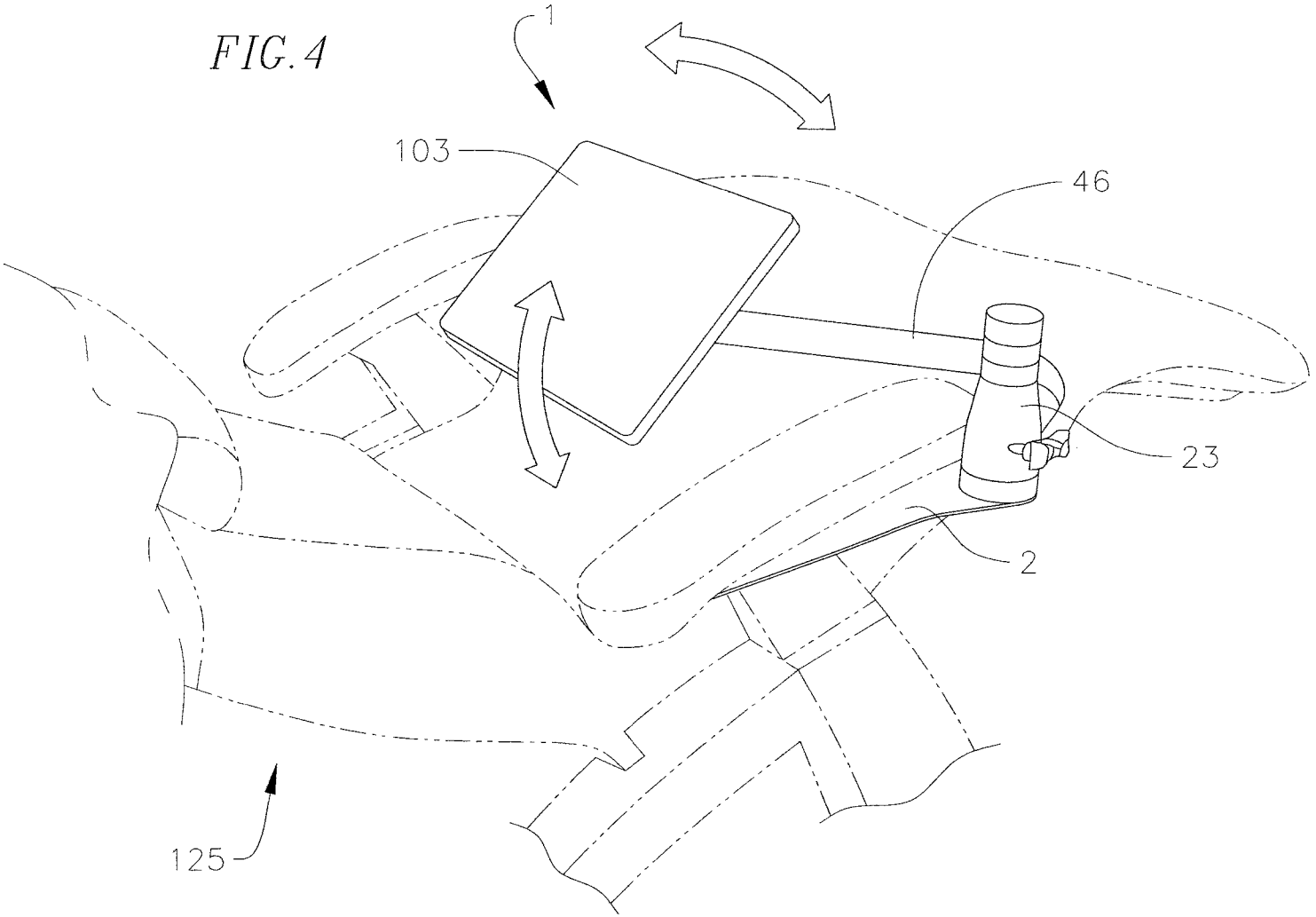
FIG. 4 is a perspective view of the laptop table assembly mounted to a recliner chair showing the pitch adjustability of the laptop table assembly.
Figure 20C:
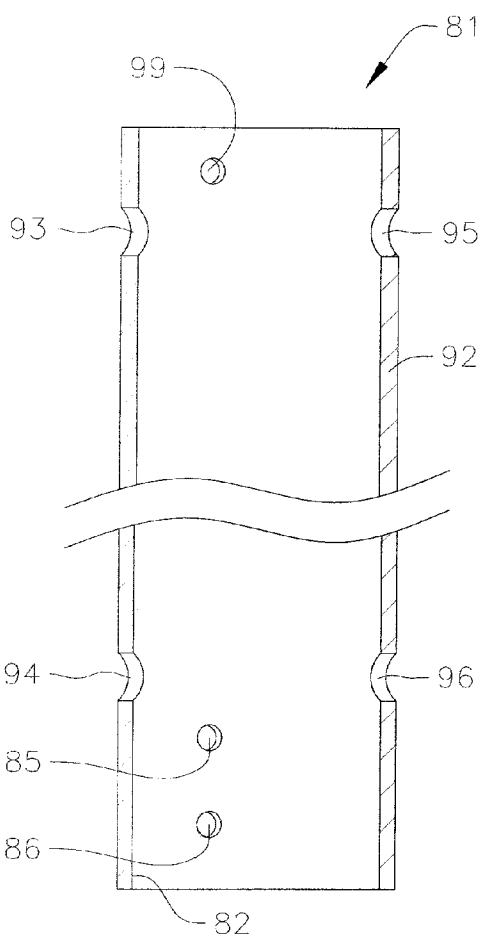
FIGS. 20A, 20B, and 20C are a top view, front view, and a cross-sectional view of the deck arm, respectively.
Figure 20B:
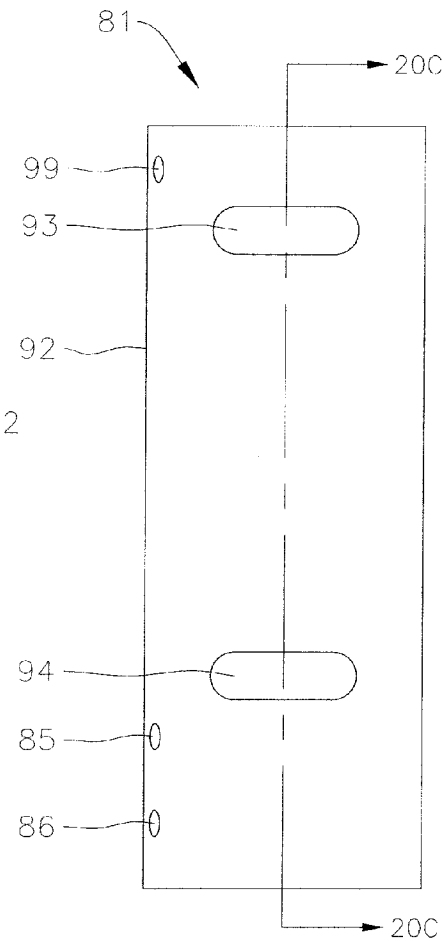
Figure 20A:
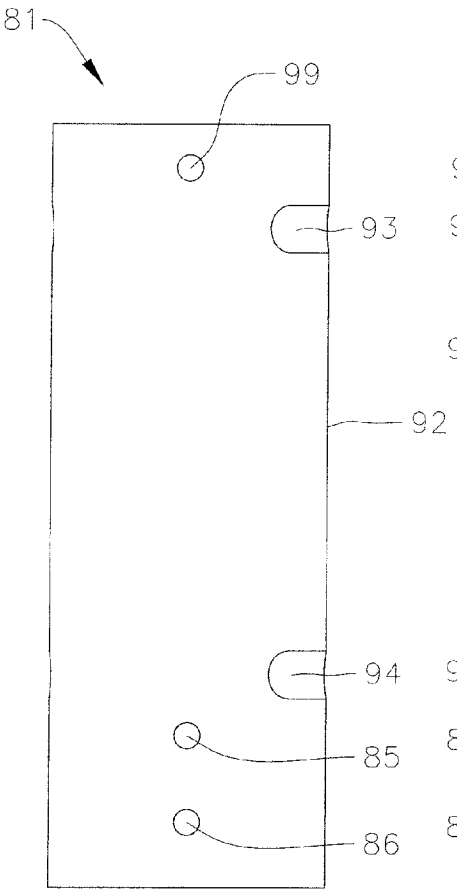
Figure 21A:
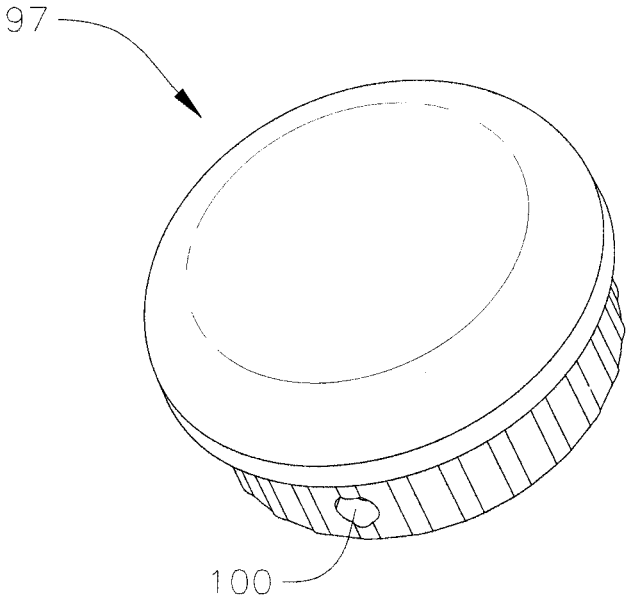
FIGS. 21A and 21B are a perspective view and a top view of the button head arm cap, respectively.
Figure 21B:
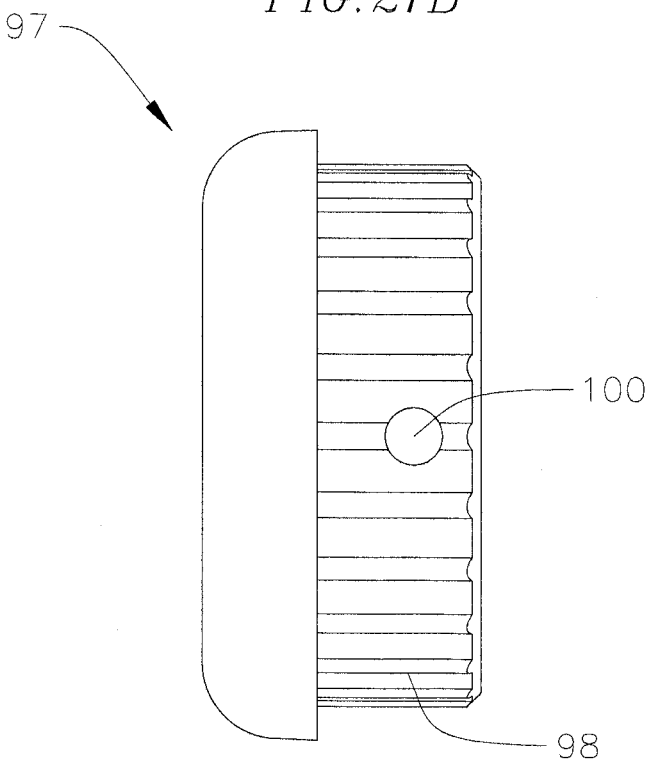

As illustrated in FIGS. 20A, 20B, and 20C, the deck arm 81 comprises a cylindrical tube 92 with the two through holes 85, 86 in its proximal end for securing the hinge 75 to the deck arm 81. The deck arm 81 also contains four ovaloid openings 93, 94, 95, 96 which permit the user to control the pitch of the laptop table 103 by rotating the laptop table 103 about a pitch axis 134, which extends through the centerline of the deck arm 81, as depicted in FIGS. 4 and 9. Two of the ovaloid openings 93, 94 are located on the forward portion of the deck arm 81 and the two other ovaloid openings 95, 96 are located on the rear portion of the deck arm 81 and are aligned with the two ovaloid openings 93, 94 on the forward portion of the deck arm 81.

Furthermore, as shown in FIGS. 6, 8, 21A, and 21B, a button head arm cap 97 is provided to seal off the distal end of the deck arm 81. The button head arm cap 97 contains a cylindrical protrusion 98 on the proximal end of the button head arm cap 97 that is configured for a press fit connection with the inner portion 82 of the deck arm 81. Additionally, the button head arm cap 97 is secured to the deck arm 81 by a fastener 132 that extends through a hole 99 in the distal end of the deck arm 81 that is configured to align with a hole 100 in cylindrical protrusion 98 formed on the button head arm cap 97. In one exemplary embodiment, the button head arm cap 97 is formed from any suitable polymer. In an alternative embodiment, the distal end of the deck arm 81 may be sealed off by a circular plate (not shown) welded to the cylindrical tube 92.

Figure 22A:
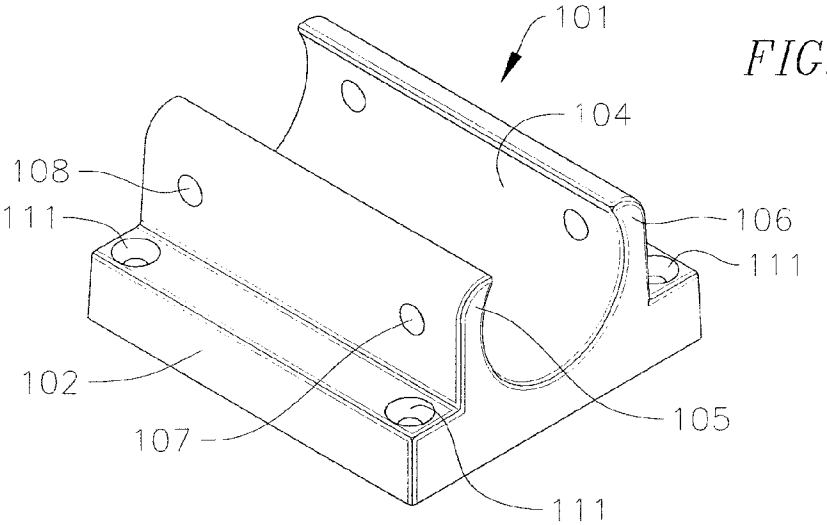
FIGS. 22A, 22B, and 22C are a perspective view, back view, and a side view of the deck tilt mount, respectively.
Figure 22C:
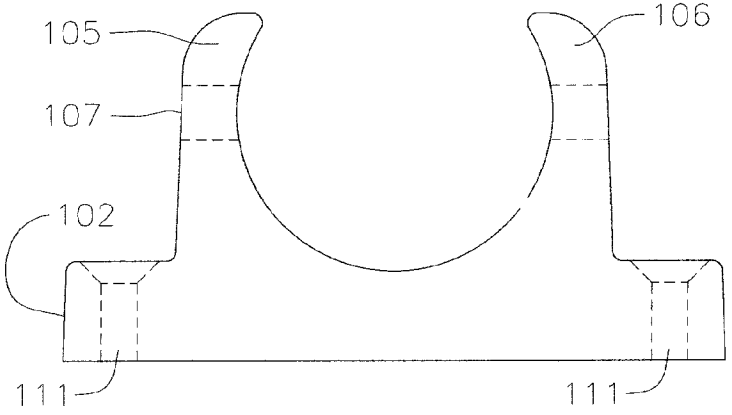
Figure 22B:
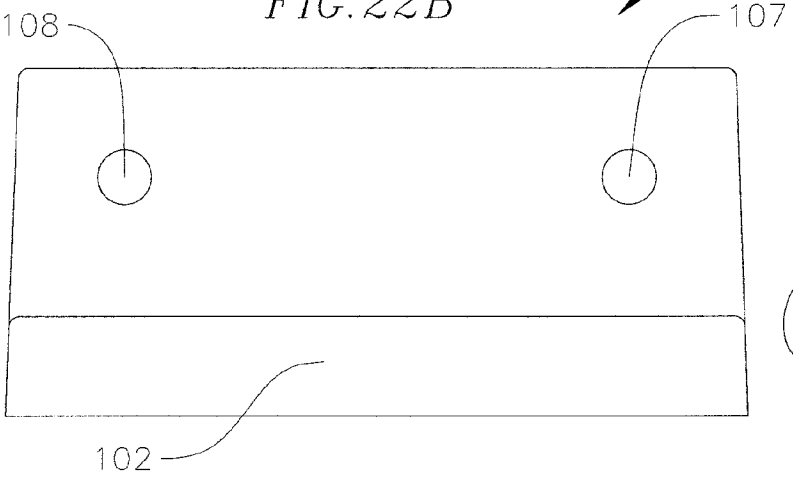

Referring now to FIGS. 22A, 22B, and 22C, a deck tilt mount 101 has a base member 102 for attaching the laptop table 103 to the deck tilt mount 101 and an open arcuate channel 104 configured to receive the deck arm 81. The open arcuate channel 104 is formed by two gripping arms 105, 106 extending downward from the base member 102. The two gripping arms 105, 106 contain two through holes 107, 108 configured to align with the ovaloid openings 93, 94, 95, 96 in the deck arm 81. Two fasteners 109, 110 extend through the through holes 107, 108 in the gripping arms 105, 106 and the ovaloid openings 93, 94, 95, 96 in the deck arm 81 to rotatably secure the deck aim 81 to the deck tilt mount 101. Adjusting the fasteners 109, 110 causes the gripping arms 105, 106 to expand or contract around the deck arm 81, thereby decreasing or increasing the force necessary to pitch the laptop table 103 about the pitch axis 134 extending through the centerline of the deck arm 81. The user pitches the laptop table 103 to achieve the appropriate working angle when the chair is in either a reclined or unreclined position. The four ovaloid openings 93, 94, 95, 96 permit the laptop table 103 to pitch to an extent corresponding to the circumferential span of the ovaloid openings 93, 94, 95, and 96. In an exemplary embodiment, the ovaloid openings 93, 94, 95, and 96 span approximately fifty degrees, which permits the laptop table 103 to pitch approximately fifty degrees. In an alternative embodiment, the ovaloid openings 93, 94, 95, and 96 may span a different distance, for example, ranging between about twenty degrees and one-hundred twenty degrees, in order to permit more or less control of the angular position of the laptop table 103 by the user.

Figure 23A:
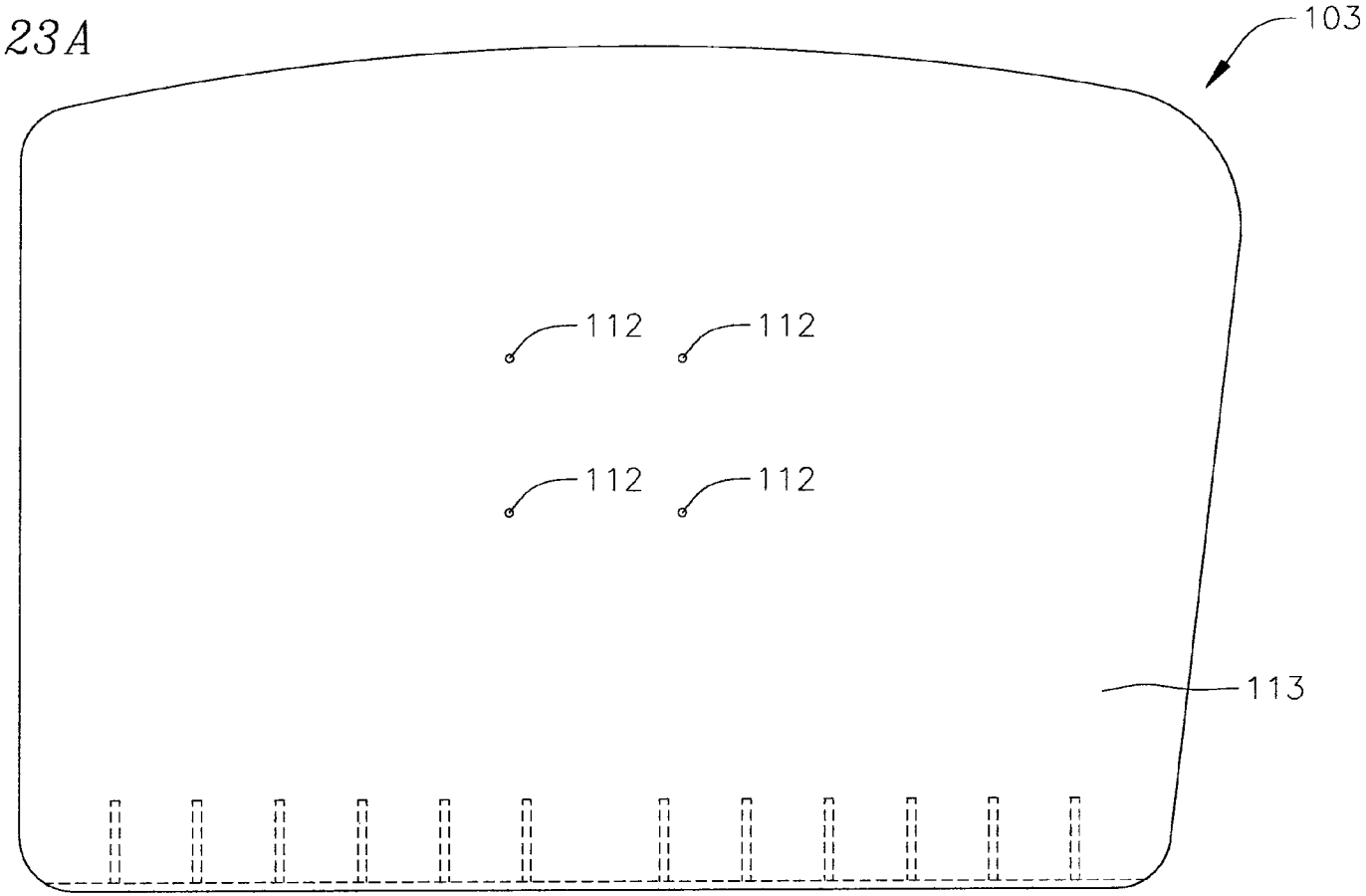
FIGS. 23A and 23B are a bottom view and a back view of the laptop table, respectively.
Figure 23B:
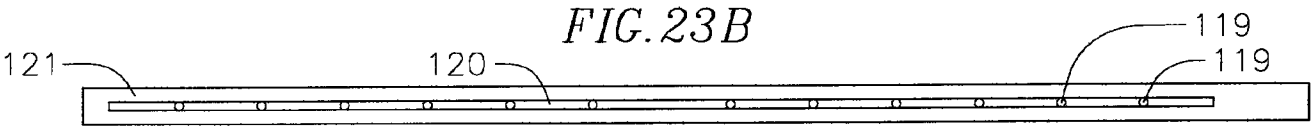
Figures 24A, 24B, 24C:
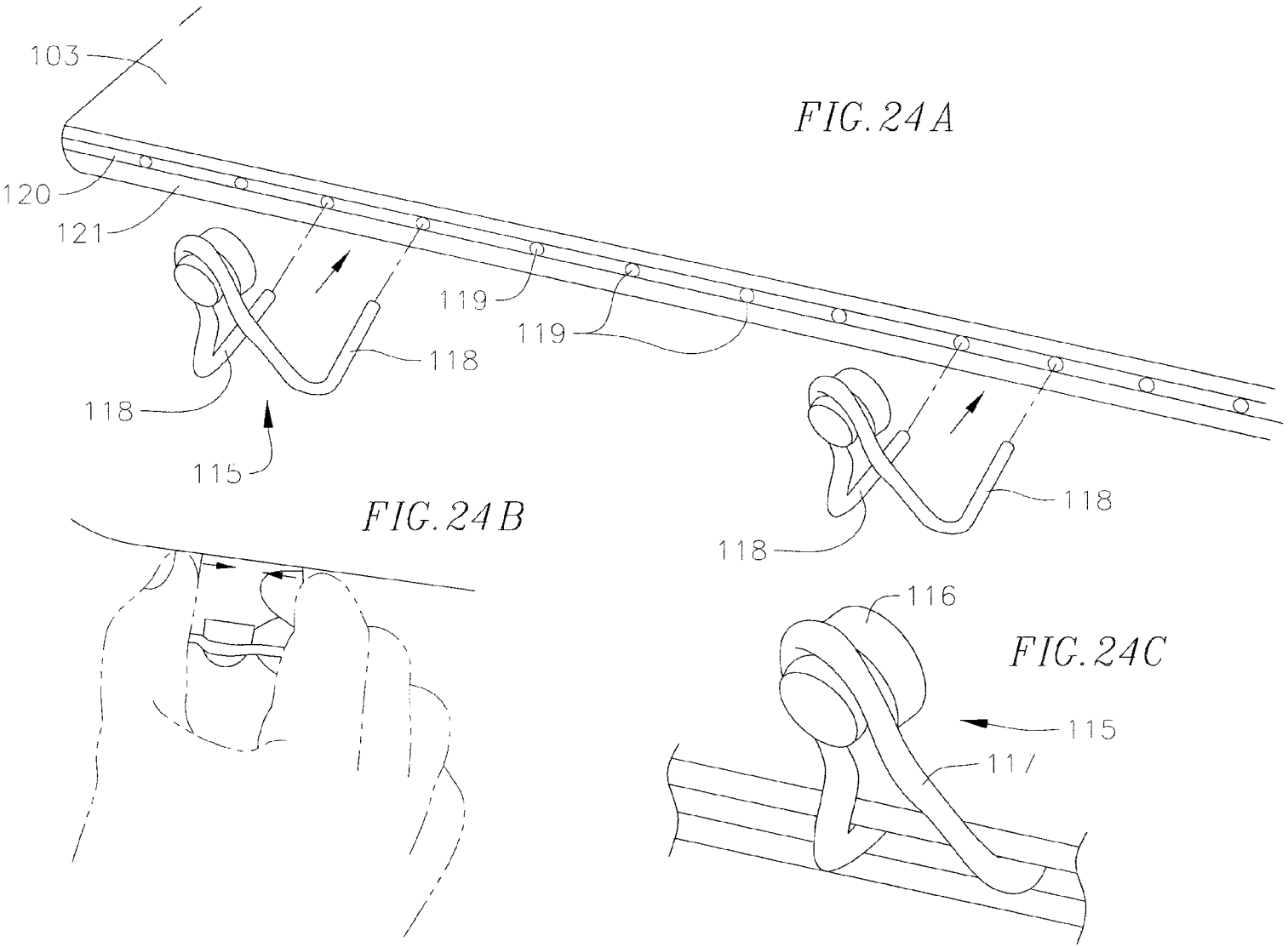
FIG. 24A is a perspective view showing the installation of the edge stop assemblies.
FIG. 24B is a perspective view showing a user installing an edge stop assembly by compressing two prongs and inserting the prongs into two holes in the laptop table.
FIG. 24C is a perspective view showing an edge stop assembly installed in the laptop table.

The base member 102 of the deck tilt mount 101 contains four countersunk holes 111 aligned with four blind holes 112 located in the lower surface 113 of the laptop table 103 (FIG. 23A). The deck tilt mount 101 is secured to the laptop table 103 with four countersunk screws 114 extending through the four countersunk holes 111 in the base member 102 and into the four blind holes 112 in the laptop table 103. 100741 As illustrated in FIGS. 5, 6, 7, 8, 24A, 24B, and 24C, a pair of edge stop assemblies 115 are provided to prevent the user's laptop from sliding off the laptop table 103 when the laptop table 103 is pitched toward the user. Each edge stop assembly 115 comprises a rubber bumper 116 secured to a flexible clip member 117. The flexible clip member 117 contains two prongs 118 configured to be inserted into a series of blind holes 119 disposed within a channel 120 formed on the rearward-facing surface 121 of the laptop table 103. The user installs the two edge stop assemblies 115 by elastically compressing the prongs 118 and inserting the prongs 118 into the appropriate pair of blind holes 119 selected by the user. The user selects the appropriate positioning of the edge stop assemblies 115 so as not to obstruct portions of the laptop requiring user access, such as an optical drive and USB ports. After the user installs the edge stop assemblies 115, the user places a laptop on the laptop table 103 and abuts at least a portion of the laptop to the edge stop assemblies 115 in order to secure the positioning of the laptop. It is contemplated that edge stop assemblies 115 with various heights may be provided to accommodate laptops with different thicknesses and configurations.

As shown in FIGS. 5 and 7, a series of cable management clips 122 attached to the swing arm 46 are provided to safely and conveniently position computer cables away from the laptop table 103. The cable management clips 122 contain an open annulus 123 for detachably attaching the cable management clips 122 to the outer wall 51 of the swing arm 46 and a small open ring 124 configured to accept the computer cables. In a preferred embodiment, two cable management clips 122 are provided. In an alternative embodiment, straps (not shown), such as fabric hook and loop fasteners or ratcheting cable ties, may be provided instead of, or in addition to, the cable management clips 122 in order to safely and conveniently secure the computer cables. It is contemplated that the number of straps or cable management clips 122 provided may vary to suit the individual needs of the user.

Figure 25:
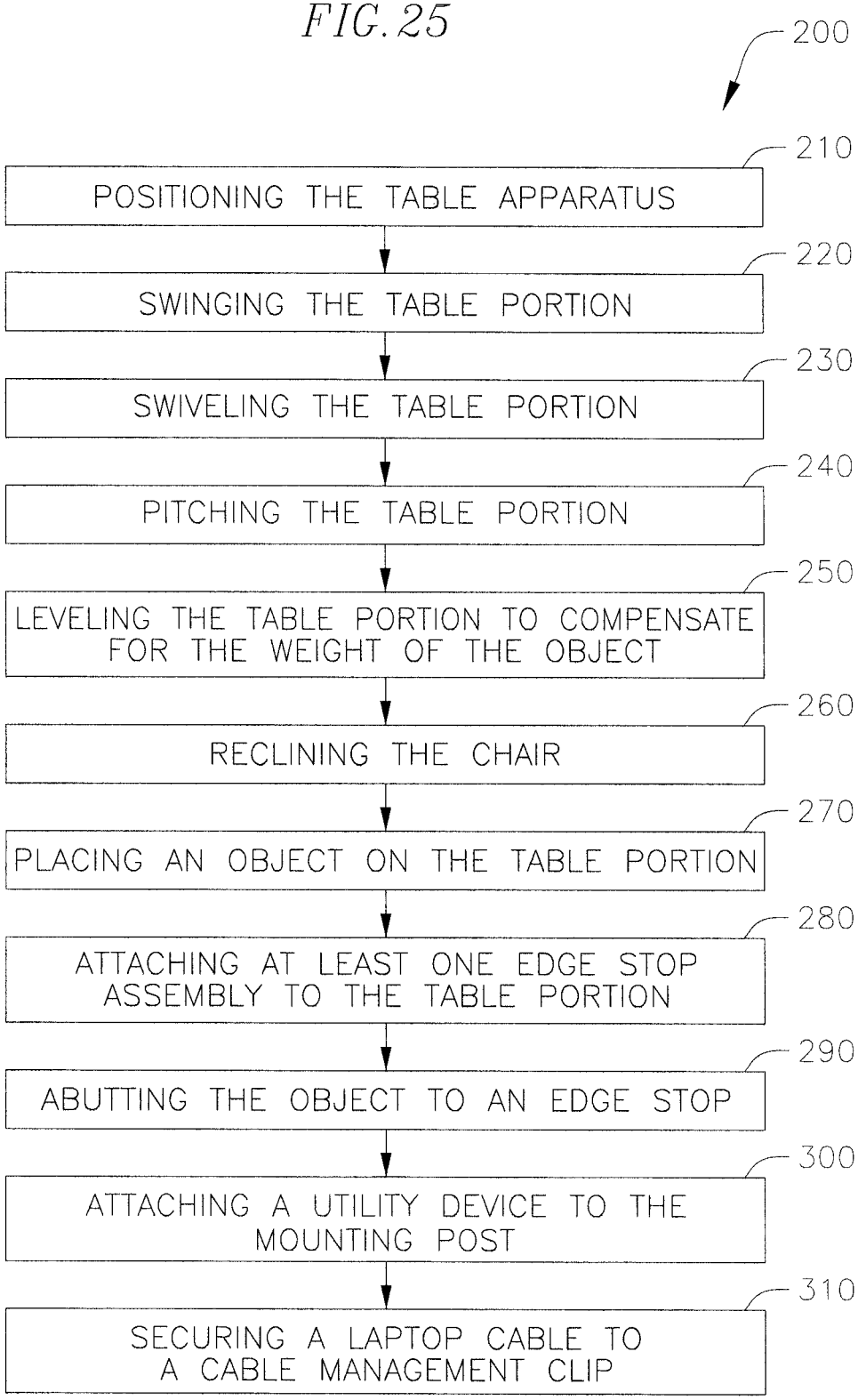
FIG. 25 is a flowchart showing tasks of a method of using a laptop table according to an embodiment of the present invention.

With reference to FIG. 25, a method 200 of using a laptop table assembly 1 is shown. In one embodiment, the method 200 includes a task 210 of positioning the laptop table assembly 1. In another embodiment, the method 200 includes a task 220 of swinging the laptop table 103 to permit, for example, the user to enter into or exit from the chair 125 or to permit the user to achieve a desired position of the laptop table 103. In a further embodiment, the method 200 includes a task 230 of swiveling the laptop table 103. Moreover, in another embodiment, the method 200 includes a task 240 of pitching the laptop table 103 to achieve, for example, a desired viewing angle of a laptop screen placed on the laptop table 103. The method 200 includes, in one embodiment, a task 250 of leveling the laptop table 103 to compensate for the weight of a laptop or any other item placed on the laptop table 103. In another embodiment, the method 200 includes a task 260 of reclining the chair 125. Further, in one embodiment, the method 200 includes one or more of the following tasks, which include a task 270 of placing a laptop on the laptop table 103, a task 280 of attaching at least one edge stop assembly 115 to the laptop table 103, and a task 290 of abutting a laptop to at least one edge stop assembly 115. In a further embodiment, the method 200 includes a task 300 of attaching a utility device, such as a secondary monitor, a lamp, or a glass holder to the mounting post 8. In another embodiment, the method 200 includes a task 310 of securing a laptop cable to at least one cable management clip 122.

While in one embodiment, the method 200 of using a laptop table assembly 1 may include each of the tasks described above and shown in FIG. 25, in other embodiments of the present invention, in a method of using a laptop table assembly 1, one or more of the tasks described above and shown in FIG. 25 may be absent and/or additional tasks may be performed.

For example, the task 240 of pitching the laptop table 103 may be performed without also performing the task 260 of reclining the chair 125. Further, in the method 200 of using the laptop table assembly 1 according to one embodiment, the tasks may be performed in the order depicted in FIG. 25. However, the present invention is not limited thereto and, in a method of using a laptop table assembly 1 according to other embodiments of the present invention, the tasks described above and shown in FIG. 25 may be performed in any other suitable sequence. For example, in one embodiment, the task 260 of reclining the chair 125 is performed before the task 240 of pitching the laptop table 103, while in an alternative embodiment, the task 240 of pitching the laptop table 103 is performed before the task 260 of reclining the chair 125.

Figure 26A:
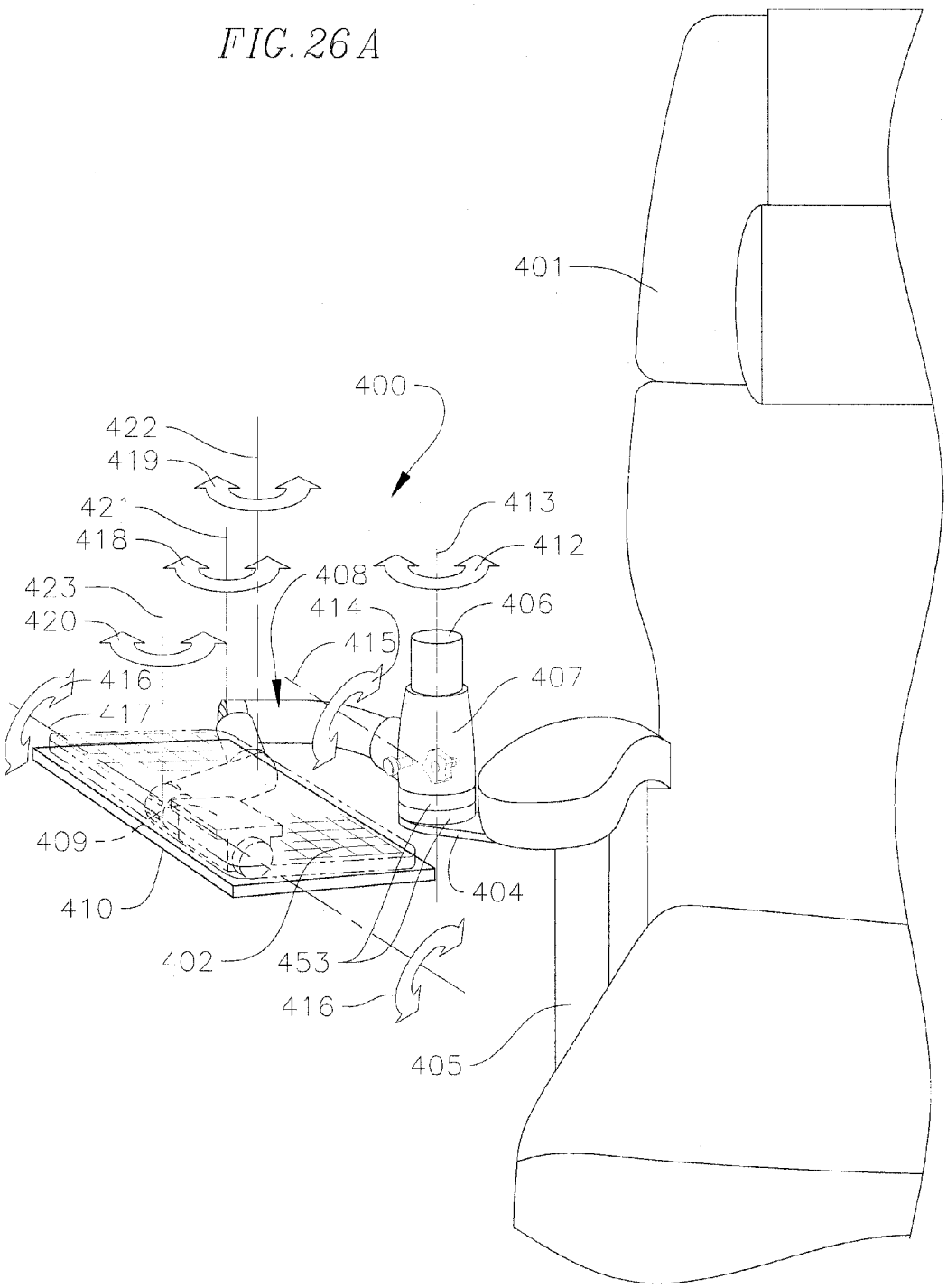
FIG. 26A is a perspective view of a computer component mounting device according to one embodiment of the present disclosure connected to a chair and supporting a keyboard.
Figure 26B:
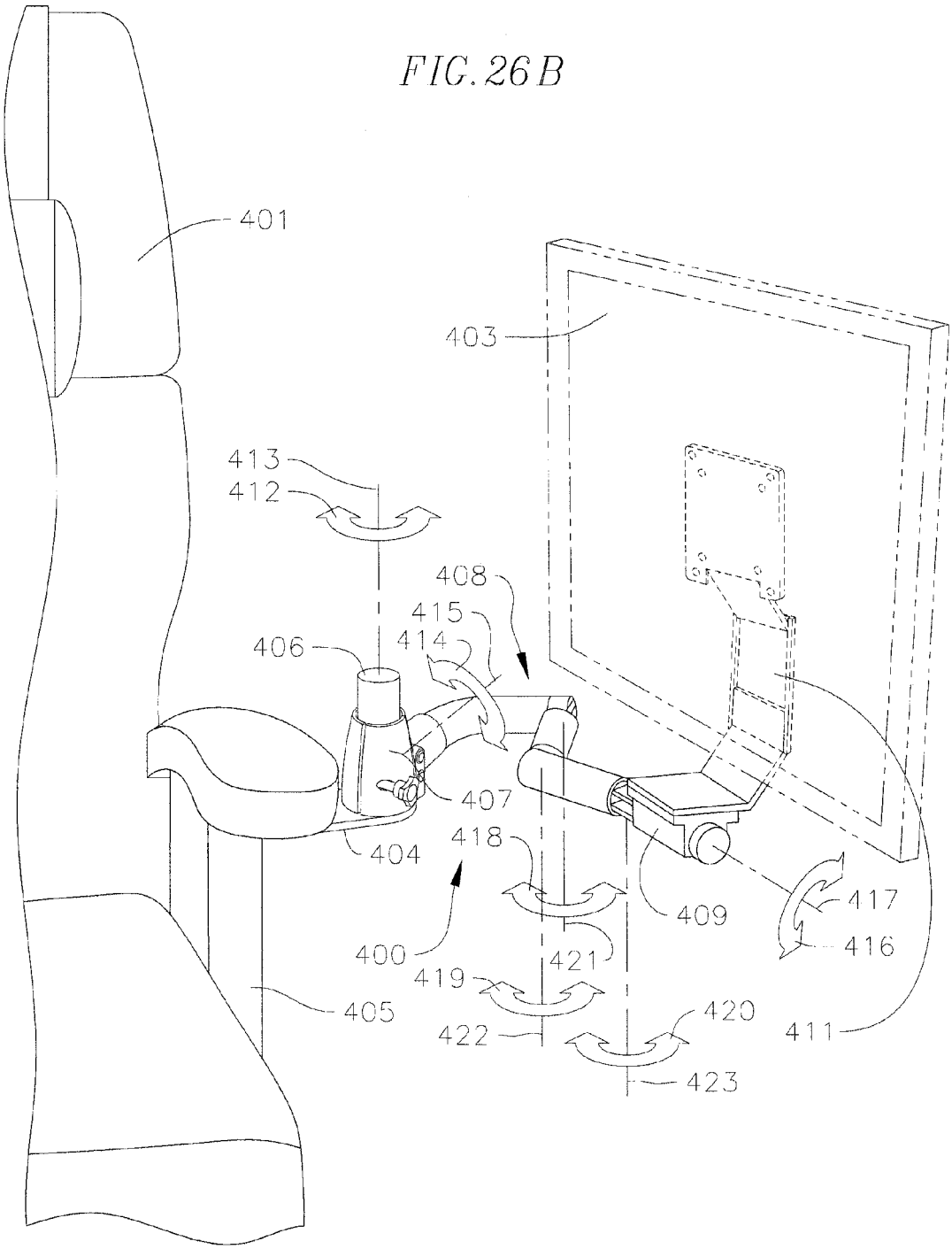
FIG. 26B is a perspective view of a computer component mounting device according to one embodiment of the present disclosure connected to a chair and supporting a computer monitor.
Figure 26C:
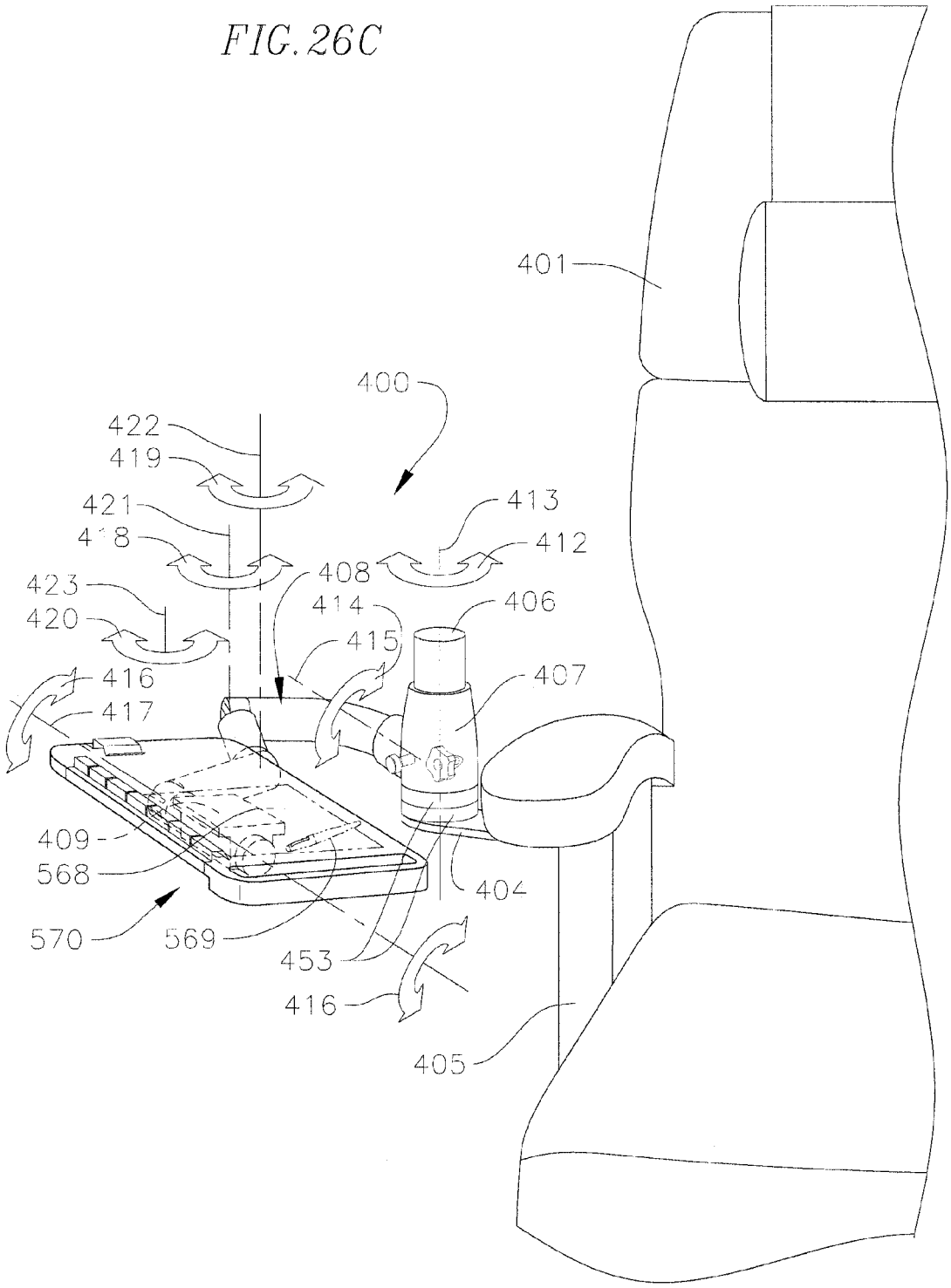
FIG. 26C is a perspective view of a computer component mounting device according to one embodiment of the present disclosure connected to a chair and supporting a support deck assembly.

With reference now to FIGS. 26A-26C, a computer component mounting device 400 according to one embodiment of the present disclosure is illustrated. The computer component mounting device 400 is configured to be coupled to an existing chair 401 (e.g., a reclining chair). In the embodiment illustrated in FIGS. 26A and 26C, the computer component mounting device 400 is coupled to a right-side of the chair 401. In the embodiment illustrated in FIG. 26B, the computer component mounting device 400 is coupled to a left-side of the chair 401. Additionally, the computer component mounting device 400 is configured to support a variety of different computer components. For instance, in the embodiment illustrated in FIG. 26A, the computer component mounting device 400 coupled to the right-side of the chair 401 is supporting a keyboard 402. In the embodiment illustrated in FIG. 26B, the computer component mounting device 400 coupled to the left-side of the chair 401 is supporting a computer monitor 403. In the embodiment illustrated in FIG. 26C, the computer component mounting device 400 is supporting stationery 568 and writing instruments 569 (e.g., pens and/or pencils). As described in detail below, the computer component mounting device 400 is configured to adjustably support the computer component or other object such that a user may adjust the computer component or other object into a desired position (e.g., an ergonomic position depending on the size of the user, the seating position of the user in the chair 401, and/or the position of the chair 401).

With continued reference to the embodiment illustrated in FIGS. 26A-26C, the computer component mounting device 400 includes a mounting bracket 404 configured to couple the computer component mounting device 400 to a component of the chair 401 (e.g., an armrest support 405 of the chair 401), a mounting post 406 coupled to the mounting bracket 404, an elbow 407 rotatably coupled to the mounting post 406, an articulable swing arm assembly 408 rotatably coupled to the elbow 407, and a deck tilt mount 409 coupled to the articulable swing arm assembly 408. The deck tilt mount 409 is configured to be coupled to and support a keyboard support tray 410 (FIG. 26A), a computer monitor support 411 (FIG. 26B), a support deck assembly 570 (FIG. 26C), or the laptop table 103 described above with reference to FIG. 23A. The computer component (e.g., a computer monitor 403, a keyboard 402, or a laptop) or other object (e.g., stationery and writing instruments) supported by the computer component mounting device 400 is configured to be swung (arrow 412) toward and away from a user seated in the chair 401 by rotating the articulable swing arm assembly 408 about a swing axis 413. The computer component supported by the computer component mounting device 400 is also configured to be leveled (arrow 414) by rotating the articulable swing arm assembly 408 about a leveling or tilt axis 415. Further, the computer component is configured to be pitched (arrow 416) by rotating the deck tilt mount 409 about a pitch axis 417. The position of the computer component or other object supported by the computer component mounting device 400 is also configured to be controlled by rotating (arrows 418, 419, 420) one or more segments of the articulable swing arm assembly 408 about axes 421, 422, 423, respectively, defined between the segments.

Figure 27:
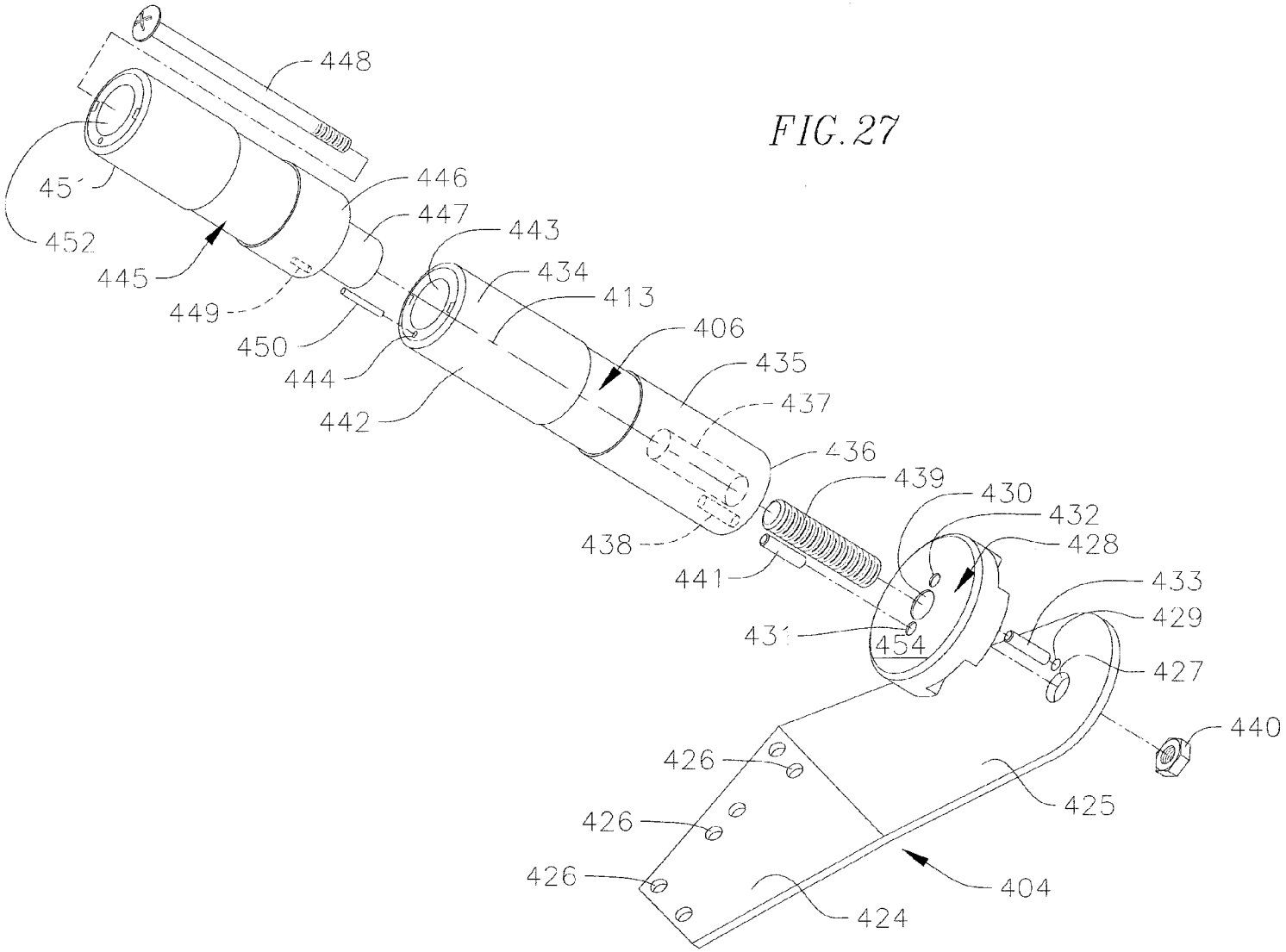
FIG. 27 is an exploded perspective view of a mounting bracket, a spacer plate, a mounting post, and an extension post according to one embodiment of the present disclosure.

With reference now to the embodiment illustrated in FIG. 27, the mounting bracket 404, which is configured to couple the computer component mounting device 300 to the chair 301, includes two flat plate segments 424, 425 angled relative to each other. In an alternate embodiment, the mounting bracket 404 may be a substantially flat plate. The first plate segment 424 also defines a plurality of holes 426 configured to receive fasteners coupling the mounting bracket 404 to the armrest support 405 of the chair 401 (i.e., fasteners are configured to extend through the holes 426 in the mounting bracket 404 and into the armrest support 405 of the chair 401). In one embodiment, the holes 426 in the mounting bracket 404 may be arranged such that the holes 426 are aligned with preexisting holes in the armrest support 405. In another embodiment, holes may be drilled into the armrest support 405 to match the arrangement of the holes 426 in the mounting bracket 404. The mounting bracket 404 may define any desired number of holes 426, such as, for instance, from two to ten holes, and the holes 426 may be arranged in any desired configuration suitable for the configuration of the armrest support 405 of the chair 401 and the desired strength of the connection between the computer component mounting device 400, and the chair 401.

With continued reference to the embodiment illustrated in FIG. 27, the second flat plate segment 425 of the mounting bracket 404 defines a relatively larger opening 427 (e.g., a hole) configured to attach a spacer plate 428 and the mounting post 406 to the mounting bracket 404. The second flat plate segment 425 also defines a relatively smaller opening 429 (e.g., a pin hole) adjacent to the larger opening 427. The relatively smaller opening 429 is configured to fix the angular position of the spacer plate 428 relative to the mounting bracket 404. In one embodiment, the mounting bracket 404 may be the same or similar to the mounting bracket 2 described above with reference to FIGS. 10A and 10B.

Still referring to the embodiment illustrated in FIG. 28, the spacer plate 428 is configured to facilitate attachment of the mounting post 406 to the mounting bracket 404. Although in the illustrated embodiment the mounting post 406 and the spacer plate 428 are separate components, in one or more alternate embodiments, the spacer plate 428 may be integrally formed with the mounting post 406 (i.e., the mounting post 406 and the spacer plate 428 may be a single, unitary component). Additionally, in one embodiment, the computer component mounting device 400 may be provided without the spacer plate 428. In the illustrated embodiment, the spacer plate 428 is a cylindrical disk defining an axial opening 430 (e.g., smooth bore or an internally threaded hole) configured to align with the larger opening 427 in the mounting bracket 404. The spacer plate 428 also defines two off-axis pin holes 431, 432 adjacent to the axial opening 430. The two off-axis pin holes 431, 432 are configured to prevent the mounting post 406 and the spacer plate 428, respectively, from rotating about their longitudinal axes. The angular position of the spacer plate 428 is fixed by aligning one of the off-axis pin holes 432 in the spacer plate 428 with the pin hole 429 in the mounting bracket 404 and inserting any suitable fastener 433, such as an anti-rotation pin, through the off-axis pin hole 432 in the spacer plate 428 and into the pin hole 429 in the mounting bracket 404.

Still referring to FIG. 27, the mounting post 406 is a cylindrical rod. A longitudinal axis of the mounting post 406 defines the swing axis 412 about which the elbow 407, the articulable swing arm assembly 408, the deck tilt mount 409, and the keyboard support tray 410 (FIG. 26A), the computer monitor support 411 (FIG. 26B), or the laptop table 103 (FIG. 23A) are configured to swing (arrow 412 in FIGS. 26A and 26B). In one embodiment, an outer surface 434 of the mounting post 406 may include a protective coating 435 configured to protect the mounting post 406 against premature wear which might otherwise result from the rotational contact between the elbow 407 and the mounting post 406 (e.g., when the elbow 407, the articulable swing arm assembly 408, and the deck tilt mount 409 are rotated (arrow 413) about the longitudinal axis of the mounting post 406). Additionally, in the illustrated embodiment, a lower end 436 of the mounting post 406 includes an axial internally threaded blind bore 437 and an off-axis smooth blind bore 438. The off-axis smooth blind bore 438 in the lower end 436 of the mounting post 406 is configured to align with the other off-axis pin hole 431 in the spacer plate 428. The mounting post 406 may be coupled to the mounting bracket 404 and the spacer plate 428 by inserting any suitable fastener 439 (e.g., an externally threaded shaft) up through the larger opening 427 in the mounting bracket 404, through the aligned opening 430 in the spacer plate 428, and into the axial internally threaded blind bore 437 in the mounting post 406. In one embodiment, the fastener 439 is an externally threaded shaft and a lower end of the externally threaded shaft is coupled to the mounting bracket 404 by a self-locking hex nut 440. In an alternate embodiment, the fastener 439 may be a hex bolt. The angular position of the mounting post 406 may be fixed by inserting any suitable fastener 441 (e.g., an anti-rotation pin) up through the other off-axis pin hole 431 in the spacer plate 428 and into the off-axis smooth blind bore 438 in the lower end 436 of the mounting post 406. Otherwise, the mounting post 406 may rotate about its longitudinal axis and thereby disengage the externally threaded shaft 439 and/or cause the hex nut 440 securing the mounting post 406 to the mounting bracket 404 to disengage the externally threaded shaft 439. Accordingly, when a user swings the computer component (e.g., a computer monitor 403, a keyboard 402, or a laptop) supported by the computer component mounting device 400 toward and away from the chair 401,the mounting post 406 remains stationary and the elbow 407 rotates (arrow 412) about the swing axis 413.

In the embodiment illustrated in FIG. 27, an upper end 442 of the mounting post 406 includes an axial smooth blind bore 443 and at least one off-axis smooth blind bore 444. The axial smooth blind bore 443 in the upper end 442 of the mounting post 406 facilitates the attachment of various utility devices (not shown) such as a lamp, a secondary monitor, a beverage holder, or a document holder. In one embodiment, an extension post 445 may be coupled to the upper end 442 of the mounting post 406. In the illustrated embodiment, the extension post 445 is a cylindrical rod. A lower end 446 of the extension post 445 includes a cylindrical projection 447 configured to extend into the axial smooth bore 443 in the upper end 442 of the mounting post 406. The extension post 445 may be coupled to mounting post 406 by a fastener 448. Additionally, in the illustrated embodiment, the lower end 446 of the extension post 445 includes an off-axis smooth blind bore 449 configured to align with the off-axis smooth blind bore 444 in the upper end 442 of the mounting post 406. Any suitable fastener 450 (e.g., an anti-rotation pin or a spring pin) may be inserted down into the off-axis blind bore 444 in the upper end 442 of the mounting post 406 and up into the off-axis blind bore 449 in the lower end 446 of the extension post 445 to prevent the extension post 445 from rotating relative to the mounting post 406 and thereby inadvertently disengaging the mounting post 406. An upper end 451 of the extension post 445 defines a smooth blind bore 452 configured to facilitate the attachment of various utility devices (e.g., a lamp, a secondary monitor, a beverage holder, or a document holder). When a utility device is not attached to the extension post 445, a cap may be inserted into the smooth blind bore 452 in the upper end 451 of the extension post 445. The smooth blind bore 452 is also configured to receive the fastener 448 coupling the extension post 445 to the mounting post 406.

In one embodiment, one or more spacer rings 453 are configured to slide onto the mounting post 406 and rest on an upper surface 454 of the spacer plate 428. As illustrated in FIG. 26A, the elbow 407 is configured to rest on the one or more spacer rings 453. Accordingly, the spacer rings 453 adjust the overall height of the computer component mounting device 400 and thus increase the usable space between the chair 401 and the computer component mounting device 400. The spacer rings 453 also increase the height of the computer component (e.g., computer monitor, keyboard, or laptop) supported by the computer component mounting device 400.

Accordingly, a user may select the appropriate number of spacer rings 453 to accommodate the user's specific body type and/or achieve the desired height of the computer component supported by the computer component mounting device 400. In one embodiment, three spacer rings 453 are provided and each spacer ring 453 is approximately 0.60 inches tall. In one or more alternate embodiments, the number of spacer rings 453 and the height of each spacer ring 453 may vary to provide the user more or less refined control over the overall height of the computer component mounting device 400. Additionally, the extension post 445 is configured to increase the extent to which the height of the computer component mounting device 400 may be adjusted by facilitating the addition of a greater number of spacer rings 453 (i.e., together, the mounting post 406 and the extension post 445 are configured to accept a greater number spacer rings 453 than the mounting post 406 alone).

Figure 28B:
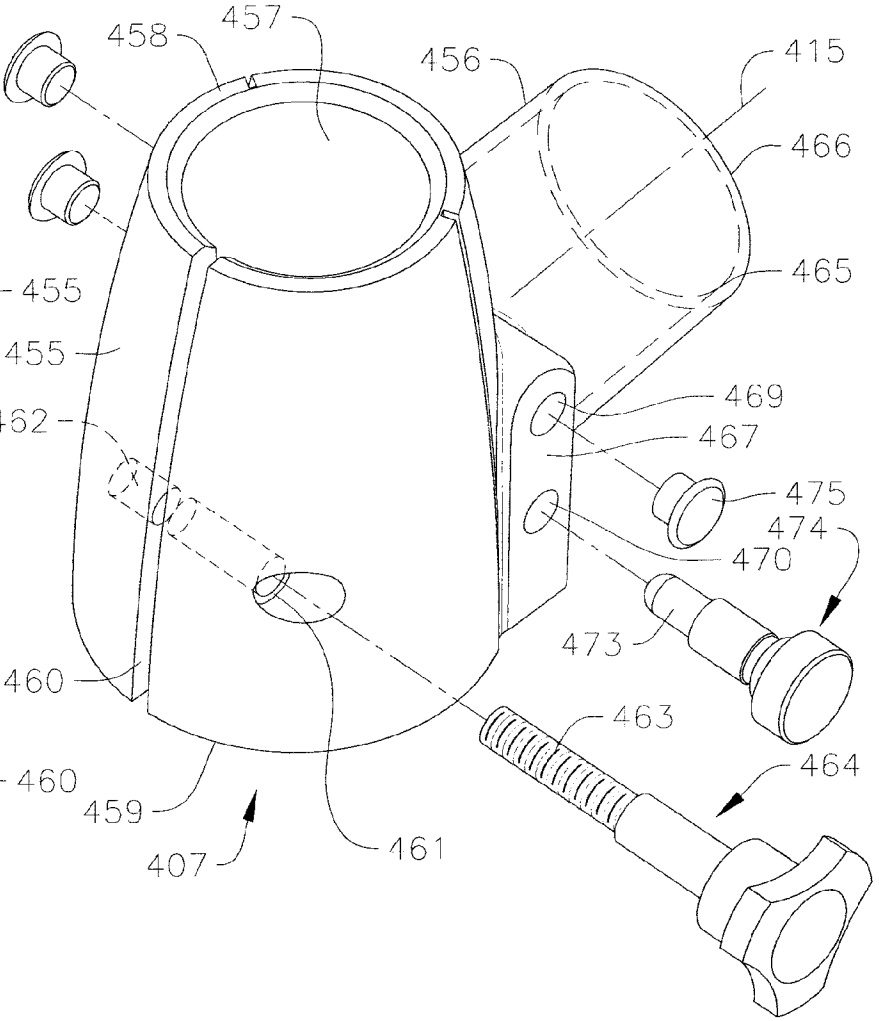
FIGS. 28A and 28B are perspective views of an elbow according to one embodiment of the present disclosure.
Figure 28A:
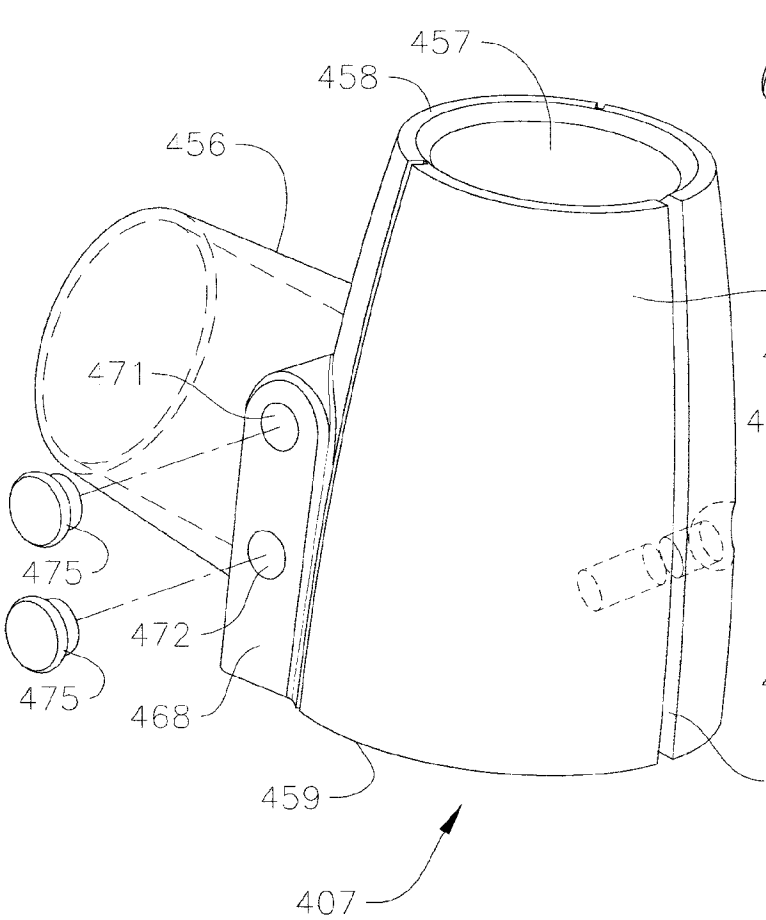

With reference now the embodiment illustrated in FIGS. 28A and 28B, the elbow 407 includes a vertical leg 455 and a horizontal leg 456. In the illustrated embodiment, the vertical leg 455 is frusto-conical and defines a cylindrical opening 457 extending from an upper end 458 of the vertical leg 455 to a lower end 459 of the vertical leg 455. The cylindrical opening 457 in the vertical leg 455 is configured to slide onto the outer surface 434 of the mounting post 406 until the lower end 459 of the vertical leg 455 rests on top of the spacer rings 453, if the user selected any spacer rings 453, or on the upper surface 454 of the spacer plate 428 if the user elected not to use any spacer rings 453. The cylindrical opening 457 in the vertical leg 455 is configured to enable the elbow 407 to rotate (arrow 412) about the swing axis 413, which extends through the longitudinal axis or centerline of the mounting post 406. Swinging (arrow 412) the elbow 407 about the swing axis 413 is configured to move the computer component (e.g., computer monitor, keyboard, or laptop) supported by the computer component mounting device 400 out of the user's way to enable the user to enter and exit the chair 401. Swinging (arrow 412) the elbow 407 about the swing axis 413 also enables the user to move the computer component into a desired working position in which the user will use the computer component.

With continued reference to the embodiment illustrated in FIGS. 28A and 28B, the elbow 407 also contains a narrow vertical slit 460 spanning from the upper end 458 to the lower end 459 of the vertical leg 455. The slit 460 permits the vertical leg 455 to circumferentially expand and contract around the mounting post 406, which decreases or increases, respectively, the amount of force necessary to swing (arrow 412) the elbow 407 about the mounting post 406. The vertical leg 455 also contains a recessed opening 461 and an internally threaded bore hole 462, on opposite sides of the slit 460, which are configured to receive a threaded shaft 463 of a knob set screw 464. When the threaded shaft 463 of the knob set screw 464 is fully inserted into the recessed opening 461, the threaded shaft 463 orthogonally spans the slit 460 and engages the internally threaded bore hole 462. Adjusting the knob set screw 464 in the clockwise direction decreases the width of the slit 460 and thereby causes the vertical leg 455 to circumferentially contract around the mounting post 406, which increases the amount of force necessary to rotate (arrow 412) the elbow 407 about the mounting post 406. In contrast, adjusting the knob set screw 464 in the counterclockwise direction increases the width of the slit 460 and thereby causes the vertical leg 455 to circumferentially expand around the mounting post 406, which decreases the amount of force necessary to rotate (arrow 412) the elbow 407 about the mounting post 406. Accordingly, the user may adjust the knob set screw 464 in either the clockwise or counterclockwise direction until a desired amount of force is necessary to swing (arrow 412) the elbow 407 about the swing axis 413.

Still referring to the embodiment illustrated in FIGS. 28A and 28B, the horizontal leg 456 of the elbow 407 is a thin-wall cylindrical tube defining a cylindrical opening 465 extending from the cylindrical opening 457 in the vertical leg 455 to an outer end 466 of the horizontal leg 456. The cylindrical opening 465 in the horizontal leg 456 of the elbow 407 is configured to receive and rotatably support a proximal end of the articulable swing arm assembly 408. A longitudinal axis of the cylindrical opening 465 in the horizontal leg 456 of the elbow 407 defines the tilt axis 415 about which the articulable swing arm assembly 408 is configured to rotate (arrow 414) to level the computer component (e.g., the computer monitor, the keyboard, or the laptop) supported by the articulable swing arm assembly 408, the deck tilt mount 409, and the keyboard support tray 410 (FIG. 26A), the computer monitor support 411 (FIG. 26B), or the laptop table 103. The level of the articulable swing arm assembly 408 is adjustable to permit a user to compensate for the weight of the computer component (e.g., computer monitor, keyboard, or laptop) supported on the articulable swing arm assembly 400, which tends to deflect the articulable swing arm assembly 408 downward. For instance, in one embodiment, the level of the articulable swing arm assembly 408 may be adjusted such that the articulable swing arm assembly 408 is substantially horizontal after the articulable swing arm assembly 408 has been deflected downward under the weight of the computer component supported by the articulable swing arm assembly 408.

As illustrated in FIGS. 28A and 28B, the elbow 407 also includes first and second bosses 467, 468 projecting outward from opposite sides of the horizontal leg 456. In the illustrated embodiment, each boss 467, 468 includes a pair of internally threaded openings 469, 470 and 471, 472, respectively, extending into the cylindrical opening 465 in the horizontal leg 456. Each of the openings 469, 470, 471, 472 is configured to receive a threaded shaft 473 of a leveling set screw 474. The threaded shaft 473 of the leveling set screw 474 is configured to extend through one of the openings 469, 470, 471, 472 and into the cylindrical opening 465 in the horizontal leg 456 to engage the articulable swing arm assembly 408. The engagement between the leveling set screw 474 and the articulable swing arm assembly 408 is configured to lock the articulable swing arm assembly 408 into the desired level (i.e., the desired tilt angle). For instance, the user may loosen the leveling set screw 474, rotate (arrow 414) the articulable swing arm assembly 408 about the tilt axis 415 into the desired leveling angle (e.g., a level compensating for the downward deflection of the articulable swing arm assembly 408 due to the weight of the computer component supported by the articulable swing arm assembly 408), and then retighten the leveling set screw 474 to set the level of the articulable swing arm assembly 408.

Additionally, the bosses 467, 468 and corresponding internally threaded openings 469, 470, 471, 472 on opposite sides of the elbow 407 facilitate the attachment of the computer component mounting device 400 on either the right-hand side or the left-hand side of the chair 401, as illustrated in FIGS. 26A and 26B. The internally threaded opening 469, 470, 471, 472 into which the leveling set screw 474 is inserted may be selected based on the side of the chair 401 onto which the computer component mounting device 400 is installed. For instance, in one embodiment, when the computer component mounting device 400 is installed on the right-hand side of the chair 401, as illustrated in FIG. 26A, the leveling set screw 474 may be inserted into one of the internally threaded openings 469, 470 on the right-hand side of the elbow 407, which are conveniently accessed by the user's right hand. When the computer component mounting device 400 is installed on the left-hand side of the chair 401, as illustrated in FIG. 26B, the leveling set screw 464 may be inserted into one of the internally threaded openings 471, 472 on the left-hand side of the elbow 407, which are conveniently accessed by the user's left hand. The three unused openings (i.e., the openings into which the leveling set screw 464 is not inserted) may be covered by inserting caps or plugs 475 into the unused openings.

Figure 29:
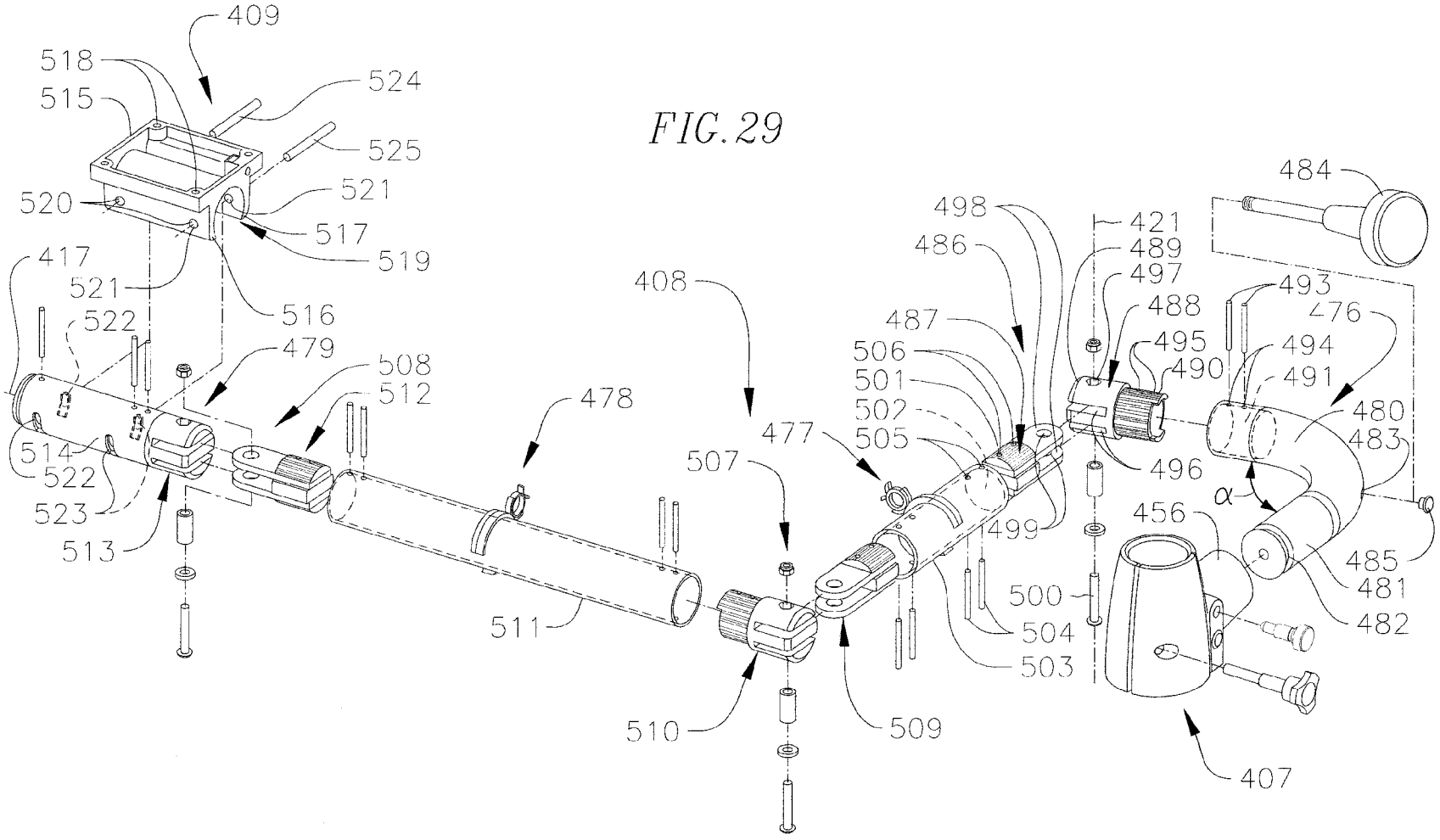
FIG. 29 is an exploded perspective view of an articulable swing arm assembly and a tilt mount bracket according to one embodiment of the present disclosure.

With reference now to the embodiment illustrated in FIG. 29, the articulable swing arm assembly 408 includes four segments 476, 477, 478, 479 hingedly connected to each other. The hingedly connected segments 476, 477, 478, 479 are configured to enable a user to position the computer component supported by the articulable swing arm assembly 400 into the desired position by rotating (arrows 418, 419, 420) one or more of the segments 476, 477, 478, 479 about one or more of the axes 421, 422, 423 defined between the segments 476, 477, 478, 479, as illustrated in FIGS. 26A and 26B. Although in the illustrated embodiment the articulable swing arm assembly 408 includes four segments 476, 477, 478, 479, in one or more alternate embodiments, the swing arm assembly 408 may include any other suitable number of segments, such as, for instance, from one to six segments, depending on the desired degree of positionability of the computer component (e.g., keyboard, computer monitor, or laptop) supported by the articulable swing arm assembly 408.

In the embodiment illustrated in FIG. 29, the first segment 476 of the articulable swing arm assembly 408 includes an angled tube 480. The angled tube 480 may define any suitable angle a, such as, for instance, from approximately 60 degrees to approximately 135 degrees. In the illustrated embodiment, the angled tube 480 defines an angle a of approximately 90 degrees. The first segment 476 also includes an attachment member 481 coupled to a proximal end of the angled tube 480. The attachment member 481 includes an outer circumferential notch 482 extending at least partially around an outer surface of the attachment member 481. The attachment member 481 may be coupled to the angled tube 480 by any suitable process, such as, for instance, bonding, welding, mechanical fastening, press-fitting, or any combination thereof. In one embodiment, the attachment member 481 may be integrally formed with the angled tube 480.

The attachment member 481 is configured to extend into the cylindrical opening 465 in the horizontal leg 456 of the elbow 407. Additionally, the outer circumferential notch 482 in the attachment member 481 is configured to receive the threaded shaft 473 of the leveling set screw 474. The engagement between the threaded shaft 473 of the leveling set screw 474 and the circumferential notch 482 in attachment member 481 sets the level of the articulable swing arm assembly 408. The circumferential notch 482 also enables the user to rotate (arrow 414 in FIGS. 26A and 26B) the articulable swing arm assembly 408 about the tilt axis 415 (see FIGS. 26A, 26B, 28A, and 28B), which is defined by the horizontal leg 456 of the elbow 407, by an angle corresponding to an angular span of the outer circumferential notch 482. The outer circumferential notch 482 may have any suitable angular span around the outer surface of the attachment member 481 depending on the desired adjustability of the articulable swing arm assembly 408, such as, for instance, from approximately 15 degrees to approximately 270 degrees. In one embodiment, the outer circumferential 482 notch spans approximately 300 degrees around the outer surface of the attachment member 481, which permits the articulable swing arm assembly 408 to rotate (arrow 414) approximately 300 degrees about the tilt axis 415 of the horizontal leg 456 of the elbow 407.

In the embodiment illustrated in FIG. 29, the angled tube 480 defines an opening 483 (e.g., an internally threaded hole) configured to receive a handle 484. The handle 484 is configured to facilitate manipulation of the position of the computer component supported by the computer component mounting device 400. For instance, a user may grasp the handle 484 and swing (arrow 412 in FIGS. 26A and 26B) the articulable swing arm assembly 408 about the swing axis 413 and/or pitch (arrow 414 in FIGS. 26A and 26B) the articulable swing arm assembly 408 about the pitch axis 415. When the handle 484 is not in use, the handle 484 may be detached from the angled tube 480 and the opening 483 in the angled tube 480 may be capped by a cap or a plug 485. In one embodiment, the articulable swing arm assembly 408 may not be provided with the handle 484.

Still referring to the embodiment illustrated in FIG. 29, the first segment 476 of the articulable swing arm assembly 408 is hingedly connected to the second segment 477 by a hinge assembly 486. In the illustrated embodiment, the hinge assembly 486 includes a hinge blade 487 hingedly coupled to a hinge blade receptacle 488. In the illustrated embodiment, the first segment 476 of the articulable swing arm assembly 408 includes the hinge blade receptacle 488 and the second segment 477 of the swing arm assembly 408 includes the hinge blade 487, although in one or more alternate embodiments, the first segment 476 may include the hinge blade 487 and the second segment 477 may include the hinge blade receptacle 488. In the illustrated embodiment, the hinge blade receptacle 488 is coupled to a distal end of the angled tube 476. The hinge blade receptacle 488 is a cylindrical post having a larger diameter distal end 489 and a smaller diameter proximal end 490. The smaller diameter proximal end 490 is configured to extend into an opening 491 in a distal end of the angled tube 480. Additionally, in the illustrated embodiment, the hinge blade receptacle 488 includes a plurality of longitudinal ridges 492 circumferentially disposed around an outer surface of the smaller diameter end 490. The longitudinal ridges 492 are configured to engage an inner diameter of the angled tube 476 when the smaller diameter end 490 is inserted into the opening 491 in the distal end of the angled tube 476. Additionally, in the illustrated embodiment, the hinge blade receptacle 488 may be secured to the distal end of the angled tube 476 by a pair of fasteners 493 (e.g., pins) extending through a pair of openings 494 in the distal end of the angled tube 480 and through a pair of aligned openings 495 in the smaller diameter end of the hinge blade receptacle 488. The larger diameter end 489 of the hinge blade receptacle 488 also defines a pair of rectangular notches or slots 496 configured to hingedly receive portions of the hinge blade 487, as described below. The larger diameter end 489 of the hinge blade receptacle 488 also defines a pivot hole 497 extending through the rectangular slots 496. In one embodiment, the hinge blade receptacle 488 may be the same or similar to the hinge 75 described above with reference to FIGS. 19A-19C.

With continued reference to the embodiment illustrated in FIG. 29, the hinge blade 487 includes a pair of spaced apart hinge blades 498. The hinge blades 498 are configured to extend into the slots 496 in the larger diameter end 489 of the hinge blade receptacle 488. Each of the hinge blades 498 also defines a pivot hole 499. The hinge blade 487 is hingedly coupled to the hinge blade receptacle 488 by a fastener 500 (e.g., a bushing and a bolt) extending through the pivot hole 497 in the larger diameter end 489 of the pivot blade receptacle 488 and the aligned pivot holes 499 in the hinge blades 498. A longitudinal axis of the fastener 500 hingedly coupling the hinge blade 487 to the hinge blade receptacle 488 defines the axis 421 about which the second segment 477 is configured to rotate (arrow 418) relative to the first segment 476, as illustrated in FIGS. 26A and 26B. Accordingly, the hinged engagement between the hinge blades 498 and the slots 496 in the hinge blade receptacle 488 enables a user to rotate (arrow 418) the second segment 477 of the articulable swing arm assembly 408 relative to the first segment 476 of the articulable swing arm assembly 408 about the axis 421. The hinge blade 487 also includes a hinge blade holder 501 configured to couple the hinge blades 498 together. The hinge blade holder 501 is configured to extend into an opening 502 in a proximal end of a straight tube 503 of the second segment 477 of the articulable swing arm assembly 408. In one embodiment, the hinge blade holder 501 and the hinge blades 498 may be integrally formed as a single, unitary component. Additionally, in the illustrated embodiment, the hinge blade 487 may be secured to the proximal end of the straight tube 503 by a pair of fasteners 504 (e.g., pins) extending through a pair of openings 505 in the proximal end of the straight tube 503 and through a pair of aligned openings 506 in the hinge blade holder 501 of the hinge blade 487. In one embodiment, the hinge blades 498 and hinge blade holder 501 may be the same or similar to the hinge blades 54, 55 and the hinge blade holders 61, 62, 63 described above with reference to FIG. 17A.

With continued reference to the embodiment illustrated in FIG. 29, the second segment 477 of the articulable swing arm assembly 408 is hingedly coupled to third segment 478 of the articulable swing arm assembly 408 by a hinge assembly 507 and the third segment 478 is hingedly coupled to the fourth segment 479 of the articulable swing arm assembly 408 by another hinge assembly 508. The hinge assemblies 507, 508 coupling the second segment 477 to the third segment 478, and the third segment 478 to the fourth segment 479, respectively, may be the same or similar to the hinge assembly 486 coupling the first segment 476 to the second segment 477 of the articulable swing arm assembly 408. In the illustrated embodiment, the second segment includes 477 a hinge blade 509 coupled to a distal end of the straight tube 503 of the second segment 477. The hinge blade 509 on the distal end of the second segment 477 is configured to hingedly connect to a hinge blade receptacle 510 coupled to a proximal end of a straight tube 511 of the third segment 478. Additionally, the third segment 478 includes a hinge blade 512 coupled to a distal end of the straight tube 511 of the third segment 478. The hinge blade 512 on the distal end of third segment 478 is configured to hingedly connect to a hinge blade receptacle 513 coupled to a proximal end of a straight tube 514 of the fourth segment 479.

Although in the illustrated embodiment each of the second, third, and fourth swing arm segments 477, 478, 479 includes a straight tube 503, 511, 514, respectively, in one or more alternate embodiments, one or more of the second, third, and fourth swing arm segments 477, 478, 479 may include a curved or bent tube. Additionally, although in the illustrated embodiment the tube 511 of the third segment 478 is longer than the tubes 503, 514 of each of the second and fourth segments 477, 479, in one or more alternate embodiments, the tubes 503, 511, 514 may have any other suitable relative lengths. For instance, in one embodiment, the tubes 503, 511, 514 of the second, third, and fourth segments 477, 478, 479 may have substantially the same length.

With continued reference to the embodiment illustrated in FIG. 29, the deck tilt mount 409 is rotatably coupled to the straight tube 514 of the fourth segment 479 of the articulable swing arm assembly 408. In the illustrated embodiment, the deck tilt mount 409 includes a rectangular base 515 and a pair of spaced apart gripping arms 516, 517 extending downward from the base 515. The base 515 of the deck tilt mount 409 is configured to support either the keyboard support tray 410 (FIG. 26A), the computer monitor support 411 (26B), or the laptop table 103 (FIG. 23A). Additionally, in the illustrated embodiment, the base 515 of the deck tilt mount 409 defines a plurality of openings 518 configured to receive fasteners securing the deck tilt mount 409 to the keyboard support tray 410, the computer monitor support 411, or the laptop table 103.

With continued reference to FIG. 29, the gripping arms 516, 517 of the deck tilt mount 409 define an arcuate channel 519 configured to receive the straight tube 514 of the fourth segment 479 of the swing arm assembly 408 (i.e., the gripping arms 516, 517 are configured to engage a portion of an outer surface of the straight tube 514). Each gripping arm 516, 517 also defines a pair of openings 520, 521 configured to align with a pair of slots 522, 523, respectively, in the straight tube 514 of the fourth segment 479 of the articulable swing arm assembly 408. Two fasteners 524, 525 extend through the openings 521, 522 in the gripping arms 516, 517 and the aligned slots 522, 523, respectively, in the straight tube 514 to rotatably secure the deck tilt mount 409 to the fourth segment 479 of the articulable swing arm assembly 408.

The slots 522, 523 enable the user to pitch (arrow 416) the deck tilt mount 409, and the keyboard support tray 410, the computer monitor support 411, or the laptop table 103 coupled to the deck tilt mount 409, about the pitch axis 417, which extends through a centerline of the straight tube 514 of the fourth swing arm segment 479 and the centerline of the arcuate channel 519 of the deck tilt mount 409. The slots 522, 523 permit the deck tilt mount 409 and the keyboard support tray 410, the computer monitor support 411, or the laptop table 103 attached to the deck tilt mount 409, to pitch (arrow 416) to an extent corresponding to the circumferential or angular span of the slots 522, 523 in the straight tube 514. For instance, in one embodiment, the slots 522, 523 span approximately 50 degrees around the straight tube 514, which permits the deck tilt mount 409 to pitch approximately 50 degrees about the pitch axis 417. In one or more alternate embodiments, the slots 522, 523 may span any other suitable angle around the straight tube 514, such as, for instance, from about 20 degrees to approximately 120 degrees, to permit more or less control of the angular orientation of the component (e.g., computer monitor, keyboard, or laptop) supported by the keyboard support tray 410, the computer monitor support 411, or the laptop table 103 coupled to the deck tilt mount 409. Accordingly, the user may pitch (arrow 416) the deck tilt mount 409 about the pitch axis 417 to achieve the desired working angle of the component (e.g., a computer monitor, a keyboard, or a laptop) supported on the deck tilt mount 409. For instance, in one embodiment in which the computer component mounting device 400 is attached to a reclinable chair 401, the deck tilt mount 409 may be tilted (arrow 416) into a first position when the reclinable chair 401 is in an upright position and then tilted (arrow 416) into a second position when the reclinable chair 401 is in a reclined position. Additionally, the fasteners 524, 525 rotatably coupling the deck tilt mount 409 to the fourth segment 514 of the articulable swing arm assembly 408 may be adjusted to cause the gripping arms 516, 517 to expand or contract around the straight tube 514 of the fourth segment 514 of the swing arm assembly 408, thereby decreasing or increasing the force necessary to pitch (arrow 416) the deck tilt mount 409, and the keyboard support tray 410, the computer monitor support 411, or the laptop table 103 coupled to the deck tilt mount 409, about the pitch axis 417. In one embodiment, the deck tilt mount 409 may be the same or similar to the deck tilt mount 101 described above with reference to FIGS. 22A-22C.

Figure 30A:
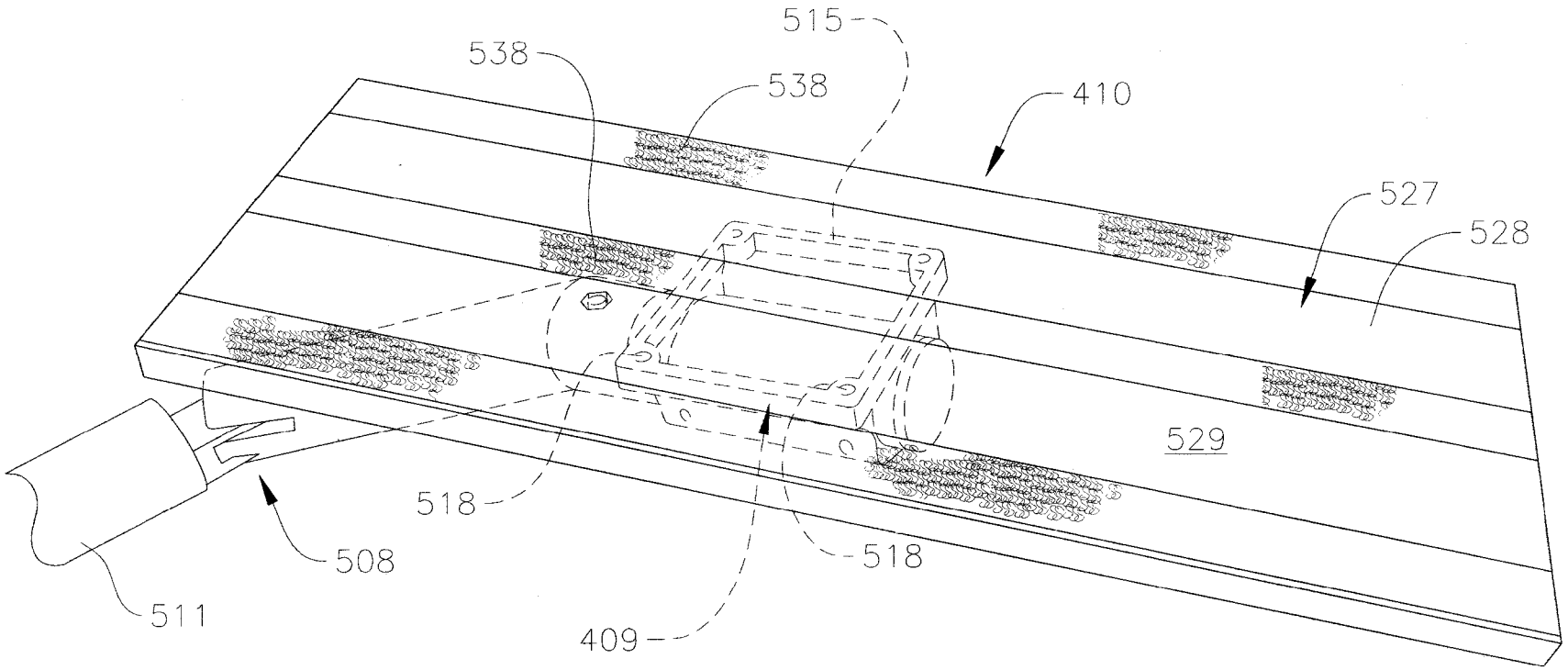
FIGS. 30A and 30B are upper and lower perspective views, respectively, of a keyboard support tray according to one embodiment of the present disclosure.
Figure 30B:
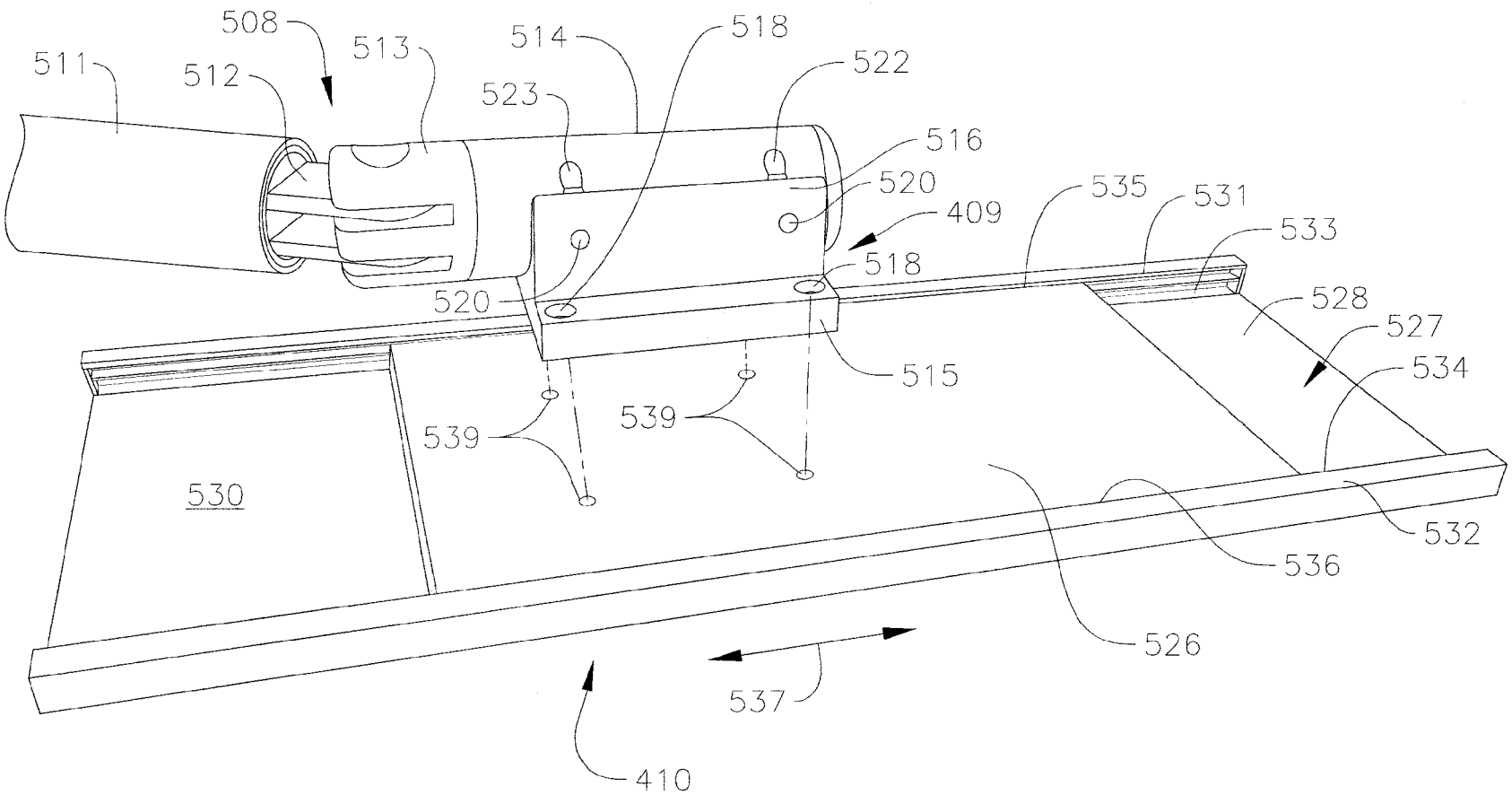

With reference now to the embodiment illustrated in FIGS. 30A and 30B, the deck tilt mount 409 is shown coupled to and supporting the keyboard support tray 410. In the illustrated embodiment, the keyboard support tray 410 includes a base plate 526 and a support tray 527 slidably coupled to the base plate 526. In the illustrated embodiment, the support tray 527 includes a rectangular, flat plate 528 having an outer surface 529 and an inner surface 530 opposite the outer surface 529. Additionally, the support tray 527 includes a pair of lips or flanges 531, 532 extending downward from the inner surface 530 of the rectangular, flat plate 528 and extending along longitudinal edges of the rectangular, flat plate 528. Together, the flanges 531, 532 define a pair of channels or rails 533, 534 configured to receive edges 535, 536 of the base plate 526. The engagement between the edges 535, 536 of the base plate 526 and the channels 533, 534 defined in the support tray 527 enables the support tray 527 to slide (arrow 537) relative to the base plate 526. The outer surface 529 of the support tray 527 is configured to support the keyboard 402, although in one or more alternate embodiments, the support tray 527 may be configured to support any other component (e.g., a computer mouse). The support tray 527 is configured to slide back and forth (arrow 537) along the base plate 526 such that the user may slide the keyboard 402 (FIG. 26A) and/or any other component supported on the support tray 527 into any desired working position. Although in the illustrated embodiment the support tray 527 is flat, in one or more alternate embodiments, the support tray 527 may be non-planar (e.g., curved), depending on the configuration of the components the support tray 527 is intended to support. Additionally, in the illustrated embodiment, the keyboard support tray 410 includes hook or loop-type fasteners 538 attached to the outer surface 529 of the support tray 527. The hook or loop-type fasteners 538 on the support tray 527 are configured to detachably engage corresponding loop or hook-type fasteners on the keyboard 402 or other component to securedly attach the keyboard 402 or other component to the keyboard support tray 410. In one or more alternate embodiments, the keyboard support tray 410 may include any other suitable type of fastener to secure the keyboard 402 or other component to the support tray 527, such as, for instance, loops or straps. The base plate 526 is configured to be fixedly coupled to the deck tilt mount 409 by a plurality of fasteners (e.g., countersunk screws) extending through a plurality of openings 539 defined in the base plate 526 and into the aligned openings 518 in the base 515 of the deck tilt mount 409.

Figure 31:
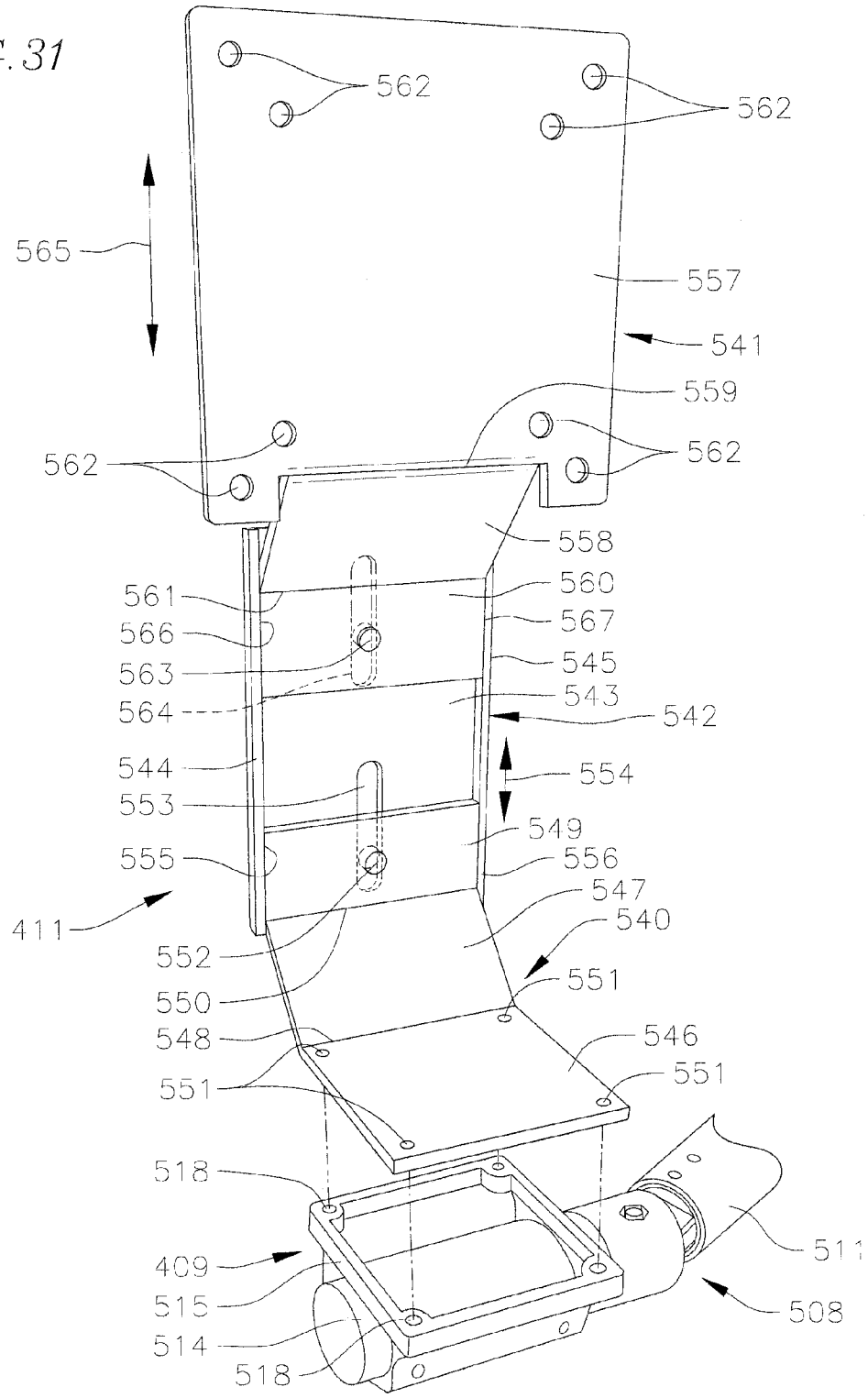
FIG. 31 is a perspective view of a computer monitor support assembly according to one embodiment of the present disclosure.

With reference now to the embodiment illustrated in FIG. 31, the deck tilt mount 409 is shown coupled to and supporting the computer monitor support assembly 411. In the illustrated embodiment, the computer monitor support assembly 411 includes a base support bracket 540, a monitor support bracket 541, and a splice bracket 542 configured to couple the base support bracket 540 to the monitor support bracket 541. In the illustrated embodiment, the splice bracket 542 includes a flat, vertical plate 543 and a pair of lips or flanges 544, 545 extending along vertical edges of the flat, vertical plate 543. Together, the flanges 544, 545 on the splice bracket 542 are configured to function as a pair of rails or guides. In the illustrated embodiment, the base support bracket 540 includes a lower, horizontal plate 546, an angled plate 547 extending upward from an edge 548 of the lower plate 546, and an upper, vertical plate 549 extending upward from an upper edge 550 of the angled plate 547. The computer monitor support assembly 411 is configured to be fixedly coupled to the deck tilt mount 409 by a plurality of fasteners extending through openings 551 defined in the lower, horizontal plate 546 and into the aligned openings 518 in the base 515 of the deck tilt mount 409.

Additionally, in the embodiment illustrated in FIG. 31, the upper, vertical plate 549 of the base support bracket 540 defines an opening 552 configured to align with a lower slot 553 in the splice bracket 542. The computer monitor support 411 also includes a lower fastener extending through the opening 552 in the upper, vertical plate 549 of the base support bracket 540 and the aligned lower slot 553 in the splice bracket 542 to couple the base support bracket 540 to the splice bracket 542. The lower slot 553 in the splice bracket 542 enables the splice bracket 542 to be adjusted upward and downward (arrow 554) relative to the base support bracket 540 to adjust the height of the component (e.g., the computer monitor) supported by the computer monitor support assembly 411. For instance, the height of the computer monitor may be adjusted by loosening the lower fastener coupling the splice bracket 542 to the base support bracket 540, sliding the splice bracket 542 up or down (arrow 554) into the desired position, and then retightening the lower fastener to fix the height of the splice bracket 542. As the splice bracket 542 is slid upward or downward (arrow 554), the flanges 544, 545 of the splice bracket 542 engage vertical edges 555, 556, respectively, of the upper, vertical plate 549 of the base support bracket 540 to maintain proper alignment between the splice bracket 542 and the base support bracket 540.

In the embodiment illustrated in FIG. 31, the monitor support bracket 541 includes an upper, vertical plate 557, an angled plate 558 extending downward from a lower end 559 of the upper, vertical plate 557, and a lower, vertical plate 560 extending downward from a lower edge 561 of the angled plate 558. The upper, vertical plate 557 defines a plurality of openings 562 configured to receive fasteners coupling the computer monitor 403 (FIG. 26B) or other suitable component to the monitor support bracket 541. Additionally, in the illustrated embodiment, the lower, vertical plate 560 defines an opening 563 configured to align with an upper slot 564 in the splice bracket 542. The computer monitor support assembly 411 also includes an upper fastener extending through the opening 563 in the lower, vertical plate 560 of the monitor support bracket 541 and the aligned upper slot 564 in the splice bracket 542 to couple the monitor support bracket 541 to the splice bracket 542. The upper slot 564 in the splice bracket 542 enables the monitor support bracket 541 to be adjusted upward and downward (arrow 565) relative to the splice bracket 542 and the base support bracket 540 to adjust the height of the component (e.g., the computer monitor 403) supported by the computer monitor support assembly 411. For instance, the height of the computer monitor 403 may be adjusted by loosening the upper fastener, sliding (arrow 565) the monitor support bracket 541 up or down into the desired position, and retightening the upper fastener to fix the height of the monitor support bracket 541 and the computer component supported thereon. As the monitor support bracket 541 is slid upward or downward (arrow 565), vertical edges 566, 567 of the lower, vertical plate 560 engage the flanges 544, 545, respectively, of the splice plate 542 to maintain proper alignment between monitor support bracket 541 and the splice bracket 542. In one or more alternate embodiments, the monitor support bracket 541 may be directly coupled to the base support bracket 540 (e.g., the computer monitor support assembly 411 may be provided without the splice bracket 542).

Figure 32:
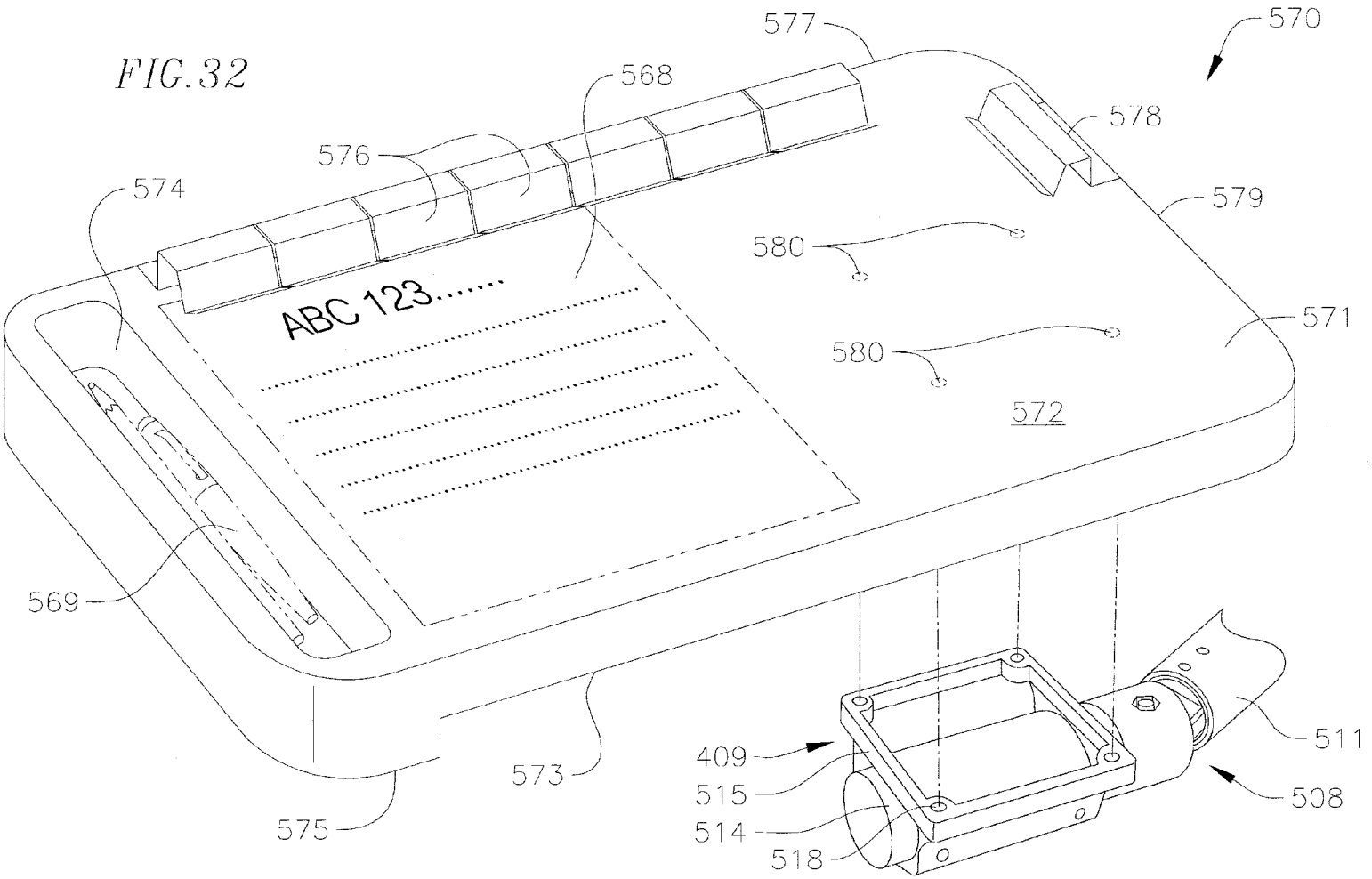
FIG. 32 is a perspective view of a support deck according to one embodiment of the present disclosure.

With reference now to the embodiment illustrated in FIG. 32, the deck tilt mount 409 is shown coupled to and supporting the support deck assembly 570. In the illustrated embodiment, the support deck assembly 570 includes a flat, rectangular plate 571 having an upper surface 572 and a lower surface 573 opposite the upper surface 572. In one or more alternate embodiment, the plate 571 may have any other suitable shape (e.g., circular) and/or may be non-planar. The upper surface 572 of the plate 571 may support stationery 568 (e.g., sheets of paper or notepads) and writing instruments 569 (e.g., pens and pencils) (see also FIG. 26C). Additionally, in the illustrated embodiment, the support deck assembly 570 includes a recess or receptacle 574 in the plate 571. The receptacle 574 may support one or more writing instruments 569 (e.g., pens or pencils) and/or any other office products, such as, for instance, paper clips or erasers. In the illustrated embodiment the receptacle 574 is rectangular, although in one or more alternate embodiments, the receptacle 574 may have any other desired shape, such as, for instance, circular or square. Additionally, in the illustrated embodiment, the support deck assembly 570 includes a projection 575 extending downward from the lower surface 572 of the plate 571. The position of the projection 575 corresponds to the position of the receptacle 574 such that the thickness of the plate 571 is substantially uniform throughout or across the plate 571 (i.e., the thickness of the projection 575 compensates for the depth of the receptacle 574). In the illustrated embodiment, the plate 571 also defines a plurality of openings 580 (e.g., blind bores extending upward from the lower surface 573 of the plate 571). The support deck assembly 570 is configured to be fixedly coupled to the deck tilt mount 409 by a plurality of fasteners extending through the openings 580 defined in the plate 571 and into the aligned openings 518 in the base 515 of the deck tilt mount 409.

With continued reference to the embodiment illustrated in FIG. 32, the support deck assembly 570 also includes a plurality of spring-loaded clips 576 coupled to an upper edge 577 of the plate 571 and at least one spring-loaded clip 578 coupled to a side edge 579 of the plate 571. The spring-loaded clips 576, 578 are configured to secure stationery 568 (e.g., sheets of paper or notepads) and/or other office products to the upper surface 572 of the plate 571. For instance, the spring-loaded clips 576, 578 may be configured to hold a sheet of paper or a notepad in place while a user writes on the sheet of paper or notepad. In one or more alternate embodiment, the support deck assembly 570 may include any other suitable types of clips configured to secure stationery and/or other office products to the plate 571. The plate 571 may be made out of any suitable durable materials, such as, for instance, wood, plastic, metal, or any combination thereof.

Although in the illustrated embodiment the computer component mounting device 400 is shown supporting a single computer component or other object, the computer component mounting device 400 may be configured to simultaneously support two or more computer components and/or other objects (e.g., both a computer monitor 403 and a keyboard 402). In one embodiment, the computer component mounting device 400 includes a first elbow, a first articulable swing arm assembly, and a first deck tilt mount configured to support a first computer component or other object (e.g., a computer monitor), and a second elbow, a second articulable swing arm assembly, and a second deck tilt mount configured to support a second computer component or other object (e.g., a keyboard). In one embodiment, the extension post 445 (FIG. 27) may be coupled to the mounting post 406 to provide sufficient room for the second elbow to be attached. For instance, in one embodiment, the elbow 407, the articulable swing arm assembly 408, the deck tilt mount 409, and the computer monitor support assembly 411 illustrated in FIG. 26B may be coupled to the mounting post 406 illustrated in FIG. 26A (or coupled to the extension post 445 that is coupled to the mounting post 406) such that the computer component mounting device 400 may support both a computer monitor 403 and a keyboard 402.

Although the drawings illustrate the embodiments of the present invention coupled to a chair (e.g., a reclinable chair), it will be apparent that the embodiments of the present invention may also be coupled to any other suitable object, such as, for instance, to a desk or a table. Also, while the above description and accompanying drawings describe and depict the embodiments of the present invention as being useable for supporting a laptop, a computer monitor, and/or a keyboard, it will be apparent that the embodiments of the present invention may also be used to support other items, such as books or writing pads. Further, it will be apparent to those skilled in the art that the present invention may incorporate or embody various combinations of the embodiments described above with respect to the shapes, sizes, and components of the various embodiments, as well as alternatives not described herein, without departing from the spirit and scope of the present invention.

The preceding description has been presented with reference to some exemplary embodiments of the invention. Persons skilled in the art and technology to which this invention pertains will appreciate that alterations and changes in the described structures and methods of assembly and operation can be practiced without meaningfully departing from the principles, spirit, and scope of this invention, as set forth in the following claims.

What is claimed is:

1. A computer component mounting apparatus, comprising:

a mounting post defining a swing axis, the mounting post configured to be coupled to a chair;

an elbow comprising a vertical leg and a horizontal leg, the vertical leg rotatably coupled to the mounting post about the swing axis, the horizontal leg defining a tilt axis;

a swing arm assembly including a proximal end and a distal end opposite the proximal end, the proximal end rotatably connected to the horizontal leg of the elbow about the tilt axis;

a deck tilt mount rotatably coupled to the distal end of the swing arm assembly about a pitch axis; and a keyboard support coupled to the deck tilt mount, the keyboard support comprising a base plate and a support plate slidably coupled to the base plate.

2. The computer component mounting apparatus of claim 1, wherein the base plate is fixedly coupled to the deck tilt mount.

3. The computer component mounting apparatus of claim 1, further comprising a pair of opposing channels defined by the support plate, and wherein the base plate is slidably received in the opposing channels.

4. The computer component mounting apparatus of claim 1, wherein the keyboard support further comprises at least one hook or loop-type fastener coupled to an upper surface of the support plate configured to detachably engage at least one corresponding loop or hook-type fastener coupled to a keyboard.

5. The computer component mounting apparatus of claim 1, wherein the swing arm assembly comprises a plurality of segments hingedly coupled to each other.

6. The computer component mounting apparatus of claim 1, further comprising a mounting bracket coupled to the mounting post and configured to couple the computer component mounting apparatus to the chair.

7. The computer component mounting apparatus of claim 1, wherein an upper end of the mounting post comprises a recess configured to connectedly receive at least one utility device.

8. The computer component mounting apparatus of claim 1, further comprising at least one spacer ring on the mounting post and below the elbow, the at least spacer ring adjusting a height of the keyboard support.

9. A computer component mounting apparatus, comprising:

a mounting post defining a swing axis, the mounting post configured to be coupled to a chair;

an elbow comprising a vertical leg and a horizontal leg, the vertical leg rotatably coupled to the mounting post about the swing axis, the horizontal leg defining a tilt axis;

a swing arm assembly including a proximal end and a distal end opposite the proximal end, the proximal end rotatably connected to the horizontal leg of the elbow about the tilt axis;

a deck tilt mount rotatably coupled to the distal end of the swing arm assembly about a pitch axis; and a computer monitor support assembly coupled to the deck tilt mount, the computer monitor support assembly comprising a monitor support bracket coupled to a base support bracket.

10. The computer component mounting apparatus of claim 9, wherein the computer monitor support assembly further comprises a splice bracket coupled to the monitor support bracket and the base support bracket, and wherein the monitor support bracket is configured to slide relative to the splice bracket to adjust a height of the monitor support bracket.

11. The computer component mounting apparatus of claim 9, wherein the monitor support bracket defines a plurality of openings configured to receive a plurality of fasteners coupling a computer monitor to the monitor support bracket.

12. The computer component mounting apparatus of claim 9, wherein the swing arm assembly comprises a plurality of segments hingedly coupled to each other.

13. The computer component mounting apparatus of claim 9, further comprising a mounting bracket coupled to the mounting post and configured to couple the computer component mounting apparatus to the chair.

14. The computer component mounting apparatus of claim 9, further comprising at least one spacer ring on the mounting post and below the elbow, the at least spacer ring adjusting a height of the computer monitor support assembly.

15. A computer component mounting apparatus, comprising:

a mounting post defining a swing axis, the mounting post configured to be coupled to a chair;

an elbow comprising a vertical leg and a horizontal leg, the vertical leg rotatably coupled to the mounting post about the swing axis, the horizontal leg defining a tilt axis;

an articulable swing arm assembly including a proximal end and a distal end opposite the proximal end, the proximal end rotatably connected to the horizontal leg of the elbow about the tilt axis, the articulable swing arm assembly comprising a plurality of segments hingedly coupled to each other; and a deck tilt mount rotatably coupled to the distal end of the articulable swing arm assembly about a pitch axis, the deck tilt mount configured to support a computer component.

16. The computer component mounting apparatus of claim 15, wherein the plurality of segments of the articulable swing arm assembly comprises a first segment, a second segment, a third segment, and a fourth segment.

17. The computer component mounting apparatus of claim 16, wherein the first segment of the articulable swing arm assembly comprises an angled tube and each of the second, third, and fourth segments comprises a straight tube.

18. The computer component mounting apparatus of claim 15, further comprising a keyboard support, a computer monitor support assembly, or a laptop table coupled to the deck tilt mount.

19. The computer component mounting apparatus of claim 15, further comprising a knob set screw coupled to the vertical leg of the elbow, wherein adjustment of the knob set screw increases or decreases the force required to rotate the elbow about the swing axis.

20. The computer component mounting apparatus of claim 15, further comprising:

an outer circumferential notch in the proximal end of the articulable swing arm assembly; and a leveling set screw coupled to the horizontal leg of the elbow and configured to engage the outer circumferential notch in the articulable swing arm assembly to set a level of the articulable swing arm assembly about the tilt axis.

21. The computer component mounting apparatus of claim 15, further comprising at least one set screw coupled to the deck tilt mount, wherein adjustment of the at least one set screw increases or decreases the force necessary to rotate the deck tilt mount about the pitch axis.

* * * * *